US011504298B1

(12) United States Patent
Tannahill

(10) Patent No.: US 11,504,298 B1
(45) Date of Patent: Nov. 22, 2022

(54) AUTOMATED STIMULATION SYSTEM AND METHOD

(71) Applicant: Exploratory Devices, LLC, Carnation, WA (US)

(72) Inventor: Vincent Tannahill, Carnation, WA (US)

(73) Assignee: Exploratory Devices, LLC, Carnation, WA (US)

( * ) Notice: Subject to any disclaimer, the term of this patent is extended or adjusted under 35 U.S.C. 154(b) by 357 days.

(21) Appl. No.: 16/863,947

(22) Filed: Apr. 30, 2020

Related U.S. Application Data

(60) Provisional application No. 62/841,596, filed on May 1, 2019.

(51) Int. Cl.
*A61H 19/00* (2006.01)

(52) U.S. Cl.
CPC ..... *A61H 19/32* (2013.01); *A61H 19/44* (2013.01); *A61H 2201/123* (2013.01); *A61H 2201/1246* (2013.01); *A61H 2201/5012* (2013.01); *A61H 2201/5025* (2013.01); *A61H 2201/5043* (2013.01); *A61H 2201/5064* (2013.01); *A61H 2201/5092* (2013.01)

(58) Field of Classification Search
CPC ..... A61H 19/00; A61H 19/30; A61H 19/32; A61H 19/34; A61H 19/40; A61H 19/44
See application file for complete search history.

(56) References Cited

U.S. PATENT DOCUMENTS

| | | | | |
|---|---|---|---|---|
| 3,910,262 | A * | 10/1975 | Stoughton | A61H 19/44 600/38 |
| 5,421,808 | A * | 6/1995 | Osbon | A61H 9/005 600/38 |
| 5,501,650 | A | 3/1996 | Gellert | |
| 6,368,268 | B1 | 4/2002 | Sandvick | |
| 7,395,126 | B2 | 7/2008 | Decker | |
| 7,608,037 | B2 | 10/2009 | Levy | |
| 8,936,544 | B2 | 1/2015 | Shahoian | |
| 9,011,316 | B2 | 4/2015 | Mertens | |
| 10,143,618 | B2 | 12/2018 | Cambridge | |
| 10,527,030 | B2 | 1/2020 | Murison | |
| 2016/0022533 | A1* | 1/2016 | Makower | A61H 23/00 601/46 |
| 2016/0045392 | A1 | 2/2016 | Massey | |
| 2016/0199249 | A1 | 7/2016 | Dunham | |
| 2018/0140502 | A1 | 5/2018 | Shahoian | |
| 2018/0344565 | A1* | 12/2018 | Sloan | A61H 19/32 |
| 2020/0188221 | A1* | 6/2020 | Lenke | A61H 9/005 |
| 2020/0214932 | A1* | 7/2020 | Pahl | A61H 9/005 |

FOREIGN PATENT DOCUMENTS

WO WO2017141037 A1 8/2017

* cited by examiner

*Primary Examiner* — John P Lacyk
(74) *Attorney, Agent, or Firm* — Roark IP

(57) ABSTRACT

A sexual stimulation system and method including a linear actuator connected by a hose or directly mounted to one of a plurality of sexual stimulation devices such as a "receiver" (for penile stimulation), an inflatable insertable device (for vaginal or anal stimulation), an actuated tube (for penile stimulation), or an actuated insertable device (for vaginal or anal stimulation). The actuator utilizes the displacement of air to drive motion, suction and pressure of the receiver or insertable device in arbitrary or predetermined patterns.

23 Claims, 30 Drawing Sheets

100

100

100

110

SHOWN WITHOUT HOUSING

SHOWN WITHOUT HOUSING

SHOWN WITHOUT HOUSING

SHOWN WITHOUT HOUSING

AUTOMATED STIMULATION SYSTEM AND METHOD

CROSS REFERENCES TO RELATED APPLICATIONS

The present application claims the benefit of U.S. Patent Provisional Application Ser. No. 62/841,596, filed on May 1, 2019. The content of this provisional application is incorporated herein in its entirety by reference

TECHNICAL FIELD

This disclosure relates to sexual stimulation system, and more particularly to employing an actuator (or pneumatic stimulation system) to provide arbitrary motion and complex sexual stimulation for male, female, non-binary and post-transition users.

BACKGROUND

Existing sexual aid devices with pneumatic pumps are often limited to sinusoidal motion by an internal mechanical mechanism. These sexual aid devices typically enable adjustment of the oscillation speed of just a mechanical linkage and/or the volume of air in the sexual aid to modify a sinusoidal motion.

SUMMARY

Figure 1A:
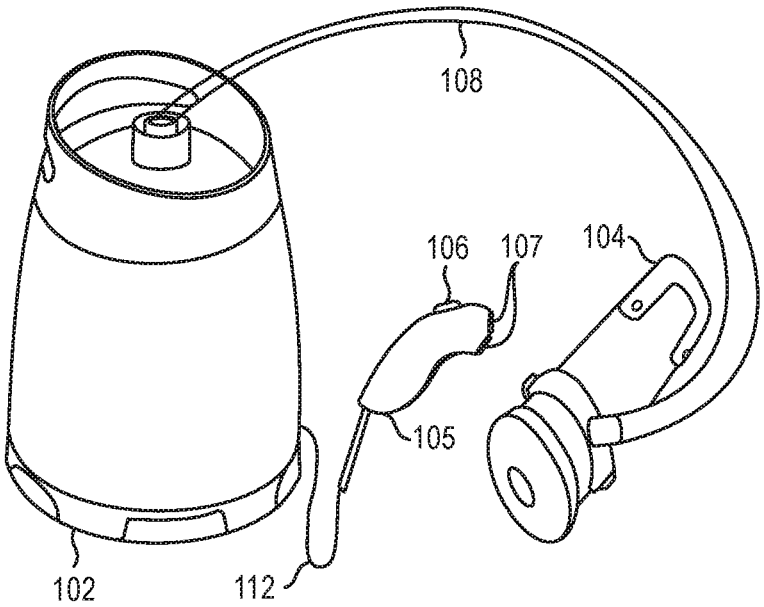
FIGS. 1A-1D show perspective views of an automated stimulation system and method 100 with a variety of stimulation devices (104, 109, 110, and 111) shown.

Aspects of the present disclosure include a sexual stimulation system comprising: an actuator comprising: a hose port connected to an air chamber; air volume in the air chamber capable of being controlled by location and movement of a piston; and wherein the piston is capable of being driven by a coil moving through a magnetic field assembly.

Further aspects of the present disclosure include a method comprising: controlling the output of an actuator by using a position sensor assembly to determine the location and movement of a piston driven through a coil moving in a magnetic field assembly to adjust the air volume in an air chamber; and feeding the output of the actuator through a hose to a stimulation device.

Further aspects of the present disclosure include a sexual stimulation system comprising: an actuator comprising: a hose port connected to an air chamber formed by an air chamber piece with integrated hose port; a first part of a rolling diaphragm attached to the air chamber piece and capable of being stationary during operation of the actuator, and a second part of the rolling diaphragm forming a seal with a piston and moving with the piston during operation of the actuator; air volume in the air chamber capable of being controlled by location and movement of the piston; wherein the piston is driven by a voice coil moving through a magnetic field assembly; a position sensor assembly includes a plurality of light emitting elements and a light sensing element in which the shaft moves in between; a cone positioned at the tip of the shaft so that the cone moves back and forth with each stroke of the piston to improve linearity of the sensed position when used with a plurality of light emitting elements.

Further aspects of the present disclosure include a control coupled to the actuator and capable of: being synchronized with motion and pressure data encoded in media and operating the motion and pressure of the actuator in an arbitrary manner and during a session.

Further aspects of the present disclosure include a stimulation device capable of being connected to the actuator by a hose at a stimulation device hose port to form a closed air circuit with the hose and air chamber of the actuator wherein the stimulation device is one of the group consisting of: a receiver, an inflatable insertable device, actuated tube device, and an actuated insertable device. Where the stimulation device is capable of being connected to the actuator by a hose at a receiver hose port to form a closed air circuit with the hose and the air chamber of the actuator; an elastic seal at a first end of the receiver capable of maintaining air tightness around a user regardless of the position of the stimulation device on the user; and a one way valve at the second end of the stimulation device to expel the air in the stimulation device.

Further aspects of the present disclosure include a receiver cap at one end of the receiver having a one-way valve which allows excess air in the receiver sleeve to be expelled. The receiver cap and an elastic seal both being capable of being snapped on or off to allow the receiver sleeve to be slid in and out of the housing. A receiver cap may be located at the end of the receiver configured to form a seal with the receiver sleeve by pinching the top of the receiver sleeve between the receiver cap and the housing to form a substantially airtight seal. A receiver seal may be located on the opposite end of the receiver from the receiver cap to form a seal with the receiver sleeve by pinching the bottom of the receiver sleeve between the seal and the housing to form a substantially airtight seal. The housing can accommodate a plurality of different sized diameters of the installed receiver sleeve. The receiver seal may have an integrated retainer ring capable of pinching the other end of the receiver sleeve between the rigid housing and itself to creating annular air volume that is sealed except for the hose port.

Further aspects of the disclosure include a sexual stimulation system comprising: an actuator comprising: a mount capable of being controlled by location and movement of a piston, wherein the piston is driven by a coil moving through a magnetic field assembly and wherein the mount is capable of supporting a tube or an insertable device.

DETAILED DESCRIPTION OF THE EMBODIMENTS

Various embodiments will be described more fully hereinafter with reference to the accompanying drawings, which form a part hereof, and which show, by way of illustration, specific embodiments by which the embodiments of the disclosure may be practiced. The embodiments may, however, be embodied in many different forms and should not be construed as limited to the embodiments set forth herein; rather, these embodiments are provided so that this disclosure will be thorough and complete, and will fully convey the scope of the embodiments to those skilled in the art. Among other things, the various embodiments may be methods, systems, or devices. The following detailed description is, therefore, not to be taken in a limiting sense. Reference elements used in one figure shall be considered to be the same element and function in a similar way if used in later figures.

Figure 1B:
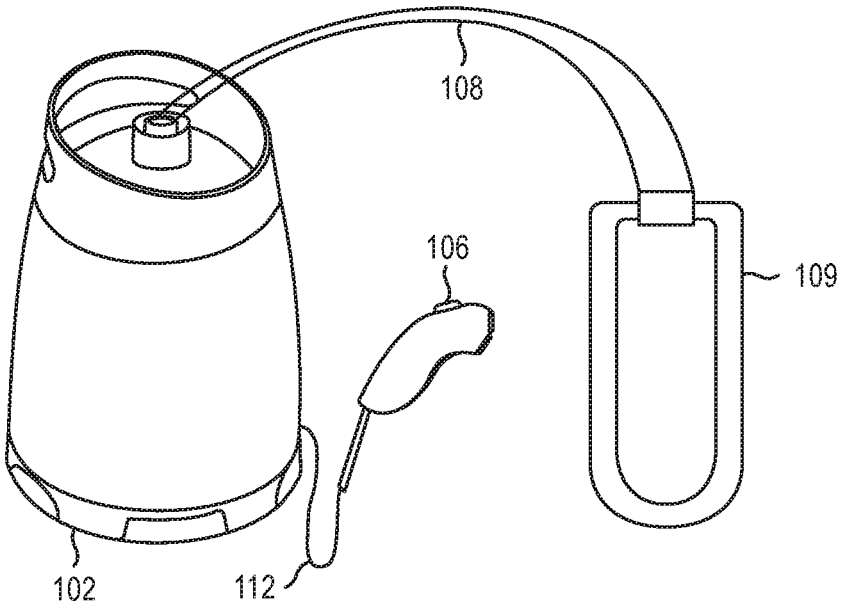
Figure 1C:
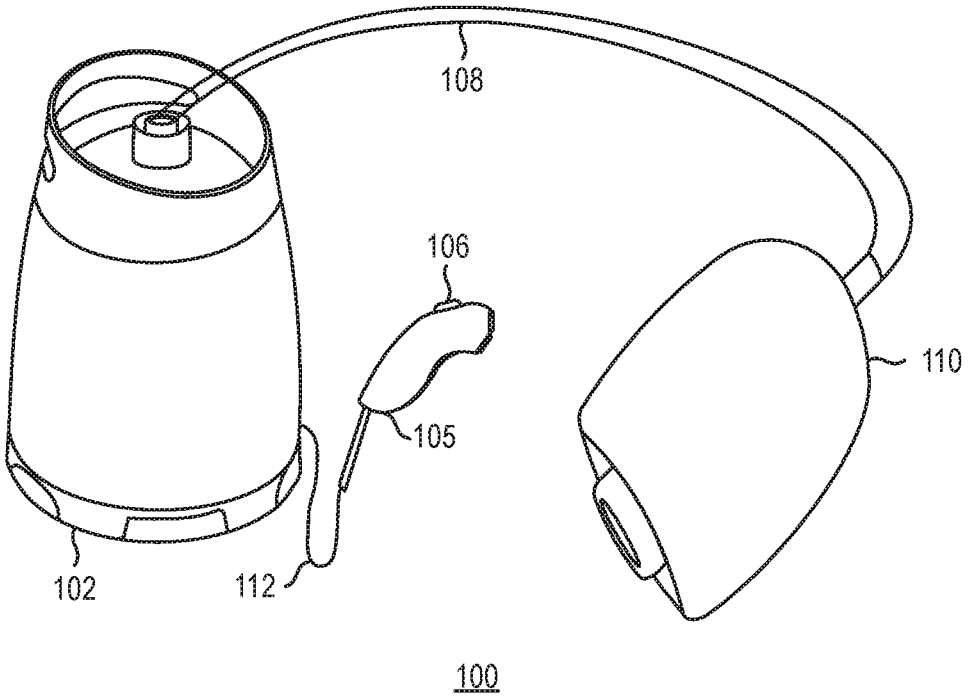
Figure 1D:
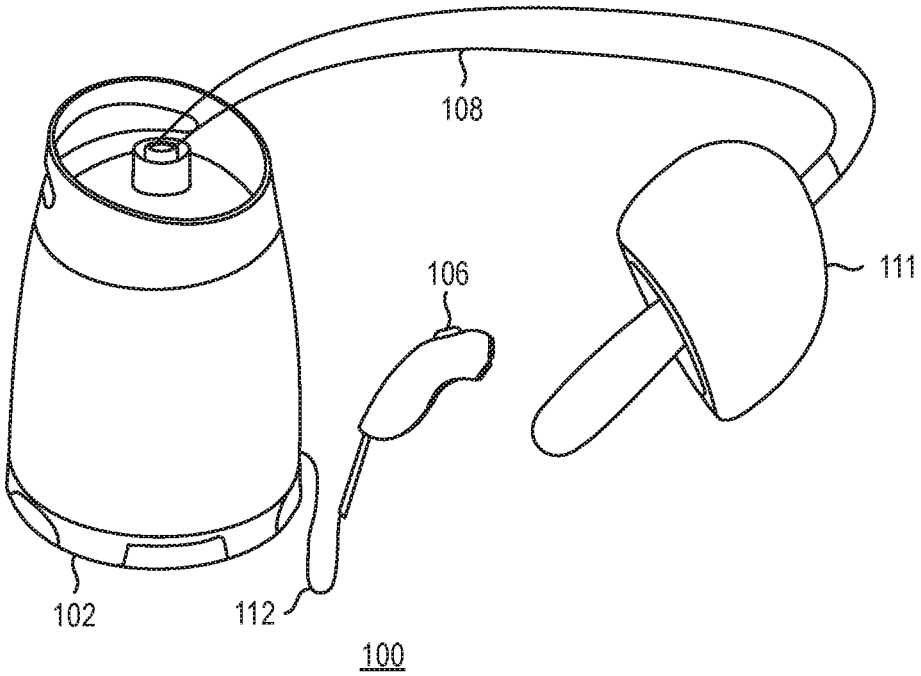

FIGS. 1A-1D show perspective views of an automated stimulation system and method 100. System 100 may be used as pneumatic sexual aid system for controlling the operation of a pumping device (i.e., actuator 102) that is capable of activating a variety of stimulation devices (104, 109, 110, and 111). FIG. 1A shows the system 100 made up of actuator 102, a stimulation device such as a receiver (or tube) 104 and an interface (for example, a hand-held pendant) 105. The interface 105, in at least one embodiment, having a rotary encoder with button 106 and a plurality of adjustment buttons 107 which could number two or more depending on the number of adjustment parameters. Actuator 102 is a pneumatic pumping device connected by a hose 108 to receiver 104 for sexual stimulation (e.g., penile stimulation). Actuator 102 can provide pressured air in patterns (e.g., sinusoidal, random, predetermined) controlled by an operator through interface 105 to a variety of attached stimulation devices (109, 110, and 111) in a similar manner as that to receiver 104. In alternative embodiments, as discussed below, the interface 105 may be replaced by a computer 298 and/or a virtual reality device 300. The interface 105 may also be connected to a computer network allowing control commands from, and feedback to, remote operators or systems (e.g. media streaming services). FIG. 1B shows an alternative embodiment of the system 100 with the receiver 104 replaced by a stimulation device such as an inflatable insertable device 109 (e.g., dildo) for vaginal or anal stimulation. FIG. 10 shows another alternative embodiment of the system 100 wherein the actuator is 102 is used to drive a stimulation device such as an actuated tube device 110. FIG. 1D shows another alternative embodiment of the system 100 wherein the actuator 102 is used to drive a stimulation device such as an actuated insertable device 111. The actuator 102 utilizes the displacement of air to drive motion, suction and/or pressure of the stimulation devices 104, 109, 110 and 111 in arbitrary or predetermined (or controlled) patterns. Interface 105 is used by an operator to control the actuator 102 through connection line 112 which will be discussed in detail below. In alternative embodiment, the connection 112 could be a wireless link. The actuator 102 is also capable of receiving information regarding the attached simulation devices by sensing the pressure in the devices 104, 109, 110 and 111 which will also be discussed in further detail below.

Figure 2:
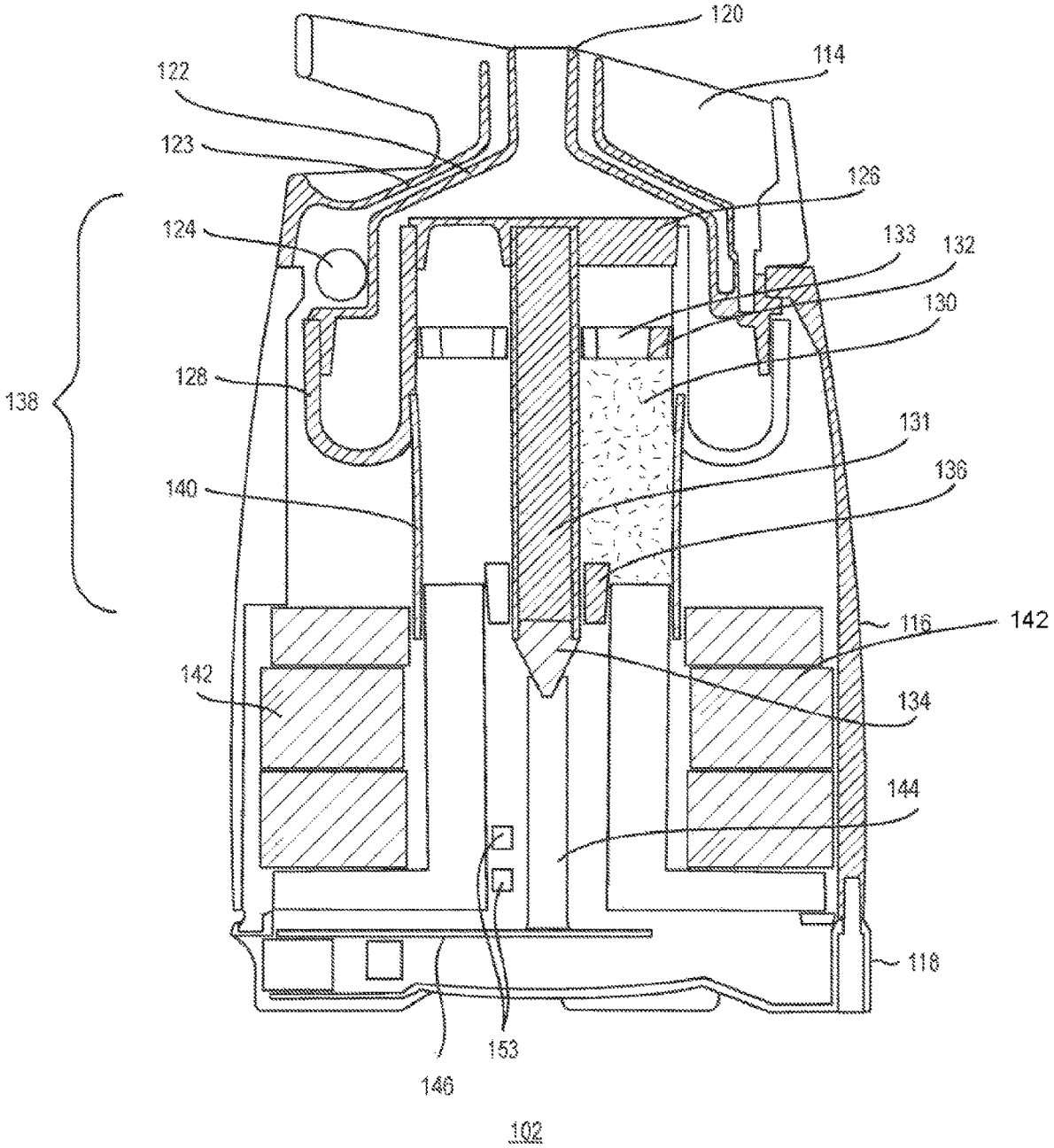
FIG. 2 is a cross-sectional view of an actuator 102.
Figure 3:
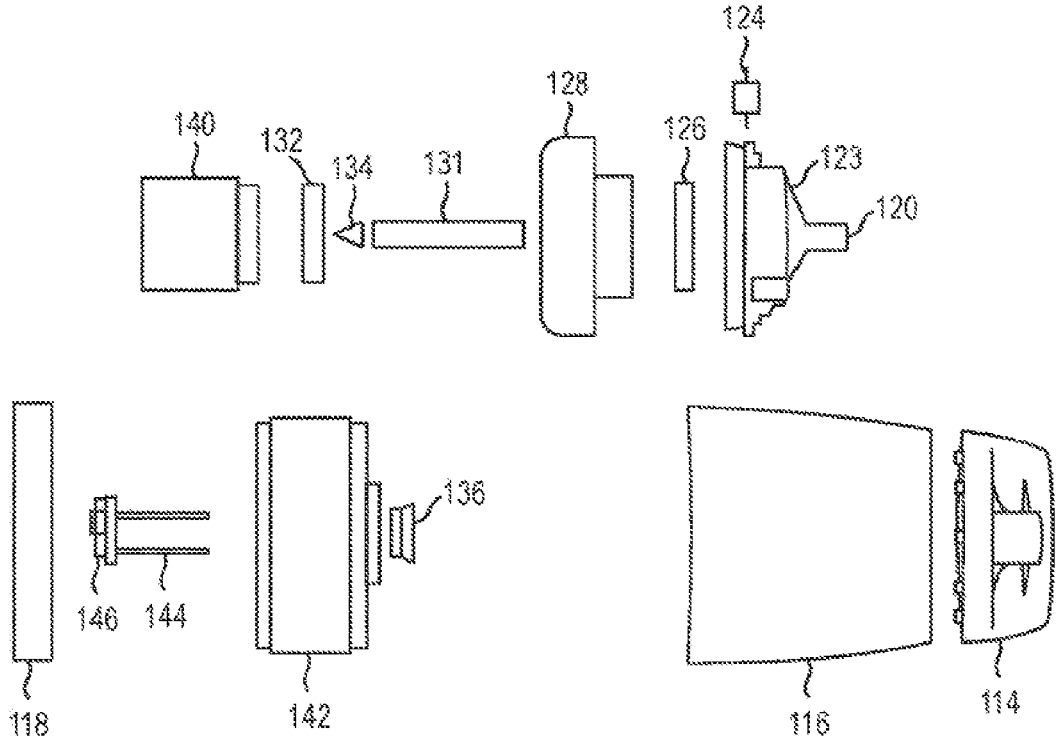
FIG. 3 is an exploded view of the parts of the actuator 102.

FIG. 2 is a cross-sectional view and FIG. 3 is an exploded view of the actuator 102. Actuator 102 is made up of a housing (or enclosure) having a top housing portion 114, middle housing portion 116, and bottom housing portion 118. Actuator hose port 120 provides a pneumatic connection for hose 108. Air chamber 122 is formed by air chamber piece 123, piston 126 and rolling diaphragm 128 allows air displacement from actuator hose port 120 to hose 108 through to a stimulation device (e.g., 104, 109, 110 or 111).

Air chamber 122 will vary in size and pressure as the piston 126 moves in a linear path in the actuator 102. In the discussion below, primary reference will be made to how the actuator 102 interacts with receiver 104 with the understanding that the same principles of operation can be applied to how the actuator 102 works with stimulation devices 109, 110, and 111 as well. A closed air circuit system is formed between the air chamber 122, hose 108 and an attached stimulation device (104, 109, 110, or 111). A first valve 124 manually or automatically adjusts the volume of air in the closed air circuit system based on air pressure or user preference. The valve 124 will be open to vent air from the air chamber 122 to atmosphere (i.e., environment outside the actuator 102) when pressure is high relative to ambient pressure (see shaded areas in FIG. 19A) to let air out and only open when pressure is lower than ambient (see shaded areas in FIG. 19B) to let air in. Ambient pressure being defined as the pressure outside the closed air circuit. The valve 124 may be electronically actuated and/or mechanically actuated. In an alternative embodiment, instead of a single valve 124, two check valves oriented in opposite directions to each other and with associated shut-off valves in-line may be used. In this alternative embodiment, the valve in-line with the check valve oriented to allow air in to the system can be opened to let air in and the other in-line valve can be opened to let air out.

As shown in FIG. 2 and FIG. 3, piston 126 is a disk (or short cylinder fitting) attached to a rolling diaphragm 128. The piston 126 is in contact with the air chamber 122 portion of a closed air circuit on one side and with the shaft 131 and an area 130 surrounding the shaft 131 on the other side. The piston 126 will move in a linear manner in the actuator 102 during operation. The closed air circuit encompasses the air chamber 122, hose 108 and a stimulation device such as receiver 104. When using the term "stroke" in relation to operation of the actuator 102 in this disclosure it shall refer to the linear movement of the voice coil assembly 138 within the actuator 102. A seal is formed between the piston 126 and an air chamber piece 123 by rolling diaphragm 128. Part of the rolling diaphragm 128 which is connected to the piston 126 moves during operation of the actuator 102 while another part of the rolling diaphragm is connected to the air chamber piece 123 is stationary during operation. The location and movement of the piston 126 will determine the volume of air in the air chamber 122. The piston 126 is mounted on the shaft 131. Support ring 132 is mounted to the coil 140 (e.g., voice coil) and also to the shaft 131. Support ring 132 has an interior hollow portion 133 which allows air to pass through. The shaft 131 may have an optional cone 134 at one end (which will be discussed below in detail). The piston 126, shaft 131 (with or without optional cone 143), support ring 132 (which may be optional), and coil 140 together make up the voice coil assembly 138. Shaft 131 slides through linear bearing 136 during operation. The linear bearing 136 ensures substantially concentric alignment of coil 140 to the magnet assembly 142. Magnet assembly 142 provides a magnetic field as discussed below. The load path for an applied force in the actuator 102 is coil 140 to support ring 132 to shaft 131 to piston 126. In alternative embodiments, the rolling diaphragm 128 (or any use of a diaphragm in this disclosure) may be replaced by a sliding dynamic seal piston and cylinder pair of sufficiently low friction.

A voice coil assembly 138 is a direct drive linear motor. The voice coil assembly 138 includes a moving coil 140 which moves in and out of a magnetic field created by the stationary, permanent magnetic field assembly (permanent magnets and ferrous steel) 142. The current flowing through the coil 140 interacts with the permanent magnetic field 142 and generates a force vector perpendicular to the direction of the current. The force vector can be reversed by changing the polarity of current flowing through the coil 140. This allows for displacement (or stroke) of the voice coil assembly 138 up and down linearly in the actuator 102 in a range of approximately 2 to 4 inches. The voice coil 140 drives the voice coil assembly 138 with a substantially constant force capability at any point along the stroke and is used in this disclosure as a closed loop position control application. The force generated by the voice coil assembly 138 is proportional to the cross product of the current flowing through the coil 140 and the magnetic flux in the permanent magnetic field, as dictated by the Lorentz force equation: $F=kBLI$, where F=force (Newtons), k=a force constant based on the geometry of the coil and magnet, B=flux density (Tesla), L=the length of wire within the magnetic field, and I=current (Amps). The force generated by the voice coil assembly 138 is relatively constant throughout the stroke of the shaft 131 with minor decreases in force at the beginning and end of the stroke. The voice coil assembly 138 can generate forces in the range of −100 to +100 Newtons of force.

Figure 4:
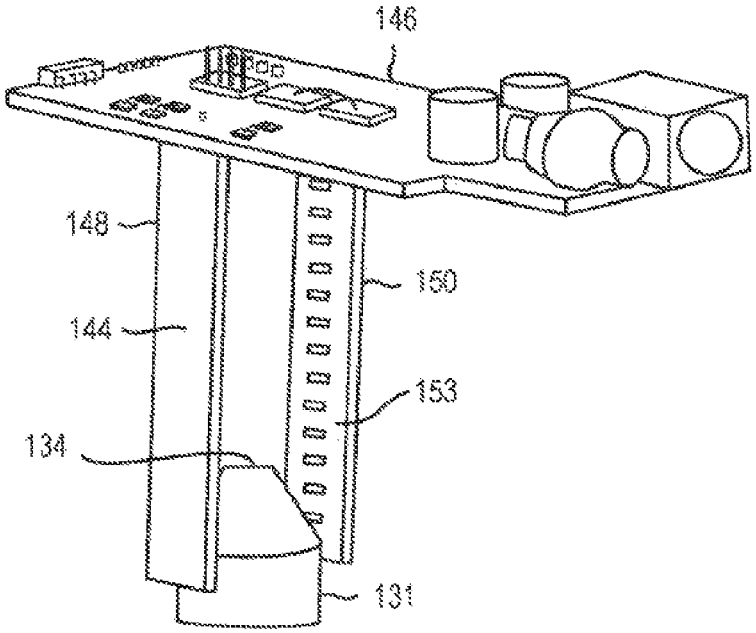
FIG. 4 shows a perspective view of an actuator controller 146 on a printed circuit board (PCB) capable of controlling operation of the actuator 102.

FIG. 4 shows a perspective view of an actuator controller 146 mounted on a printed circuit board (PCB) in relation to the shaft 131. The actuator controller 146 controls operations of the actuator 102. The actuator controller 146 may utilize a proportional-integral (PI) or proportional-integral-derivative (PID) control to control the position of the voice coil assembly 138. The PI and PID controls are control loop mechanisms capable of reading a sensor, then computing the desired actuator 102 output by calculating proportional and integral (i.e., PI) or proportional, integral and derivate (i.e., PID) responses and summing these components to compute the output. The actuator controller 146 employs voice coil 140 to change the voice coil assembly 138 position based in part on feedback from a position sensor assembly 144. Position sensor assembly 144 operates on the principal of occlusion of a sensing element by a position of a member such as the shaft 131 to be measured. The position sensor assembly 144 may be made up of a sensing element (e.g., photovoltaic cell) 148 and light emitting strip 150. The sensing element 148 may be rectangular shaped and physically positioned opposing light emitting strip 150 which has a regulated output. The light-emitting strip 150 may be composed of a continuous light emitting element or an array of light emitting elements (e.g., light emitting diodes (LEDs)) 152. The light emitting elements 152 may be distributed uniformly and linearly along a circuit board. The wavelength of the emitted light may be tuned to correspond to the peak sensitivity of the sensing element 148 to minimize power consumption. The sensing element 148 may be a single continuous photovoltaic cell or an array of photovoltaic cells connected electrically in parallel. The position of any opaque object (e.g., shaft 131) placed between these two parallel elements (in a manner which occludes a portion of the photovoltaic cell proportional to the position of the shaft 131) can be determined relative to the sensing element 148 by measuring the current produced by the photovoltaic cell.

Figure 5A:
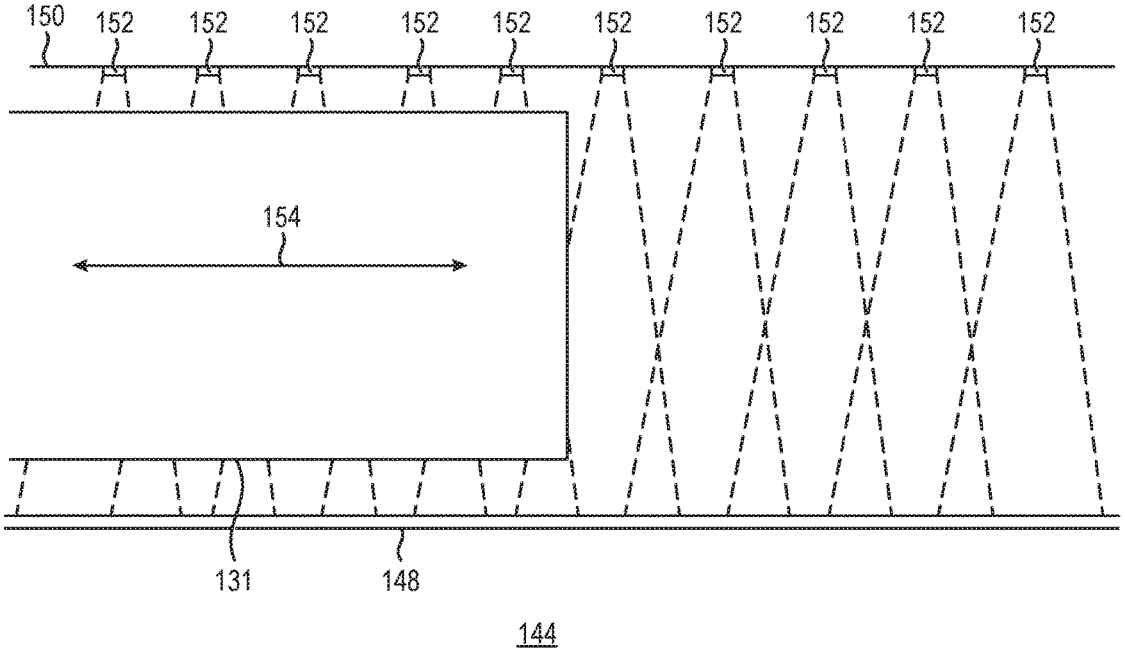
FIG. 5A shows a position sensor assembly 144 measuring the position of shaft 131 using a light sensing element 148 and light source 150 as it moves back and forth in each stroke as indicated by arrow 154.
Figure 5B:
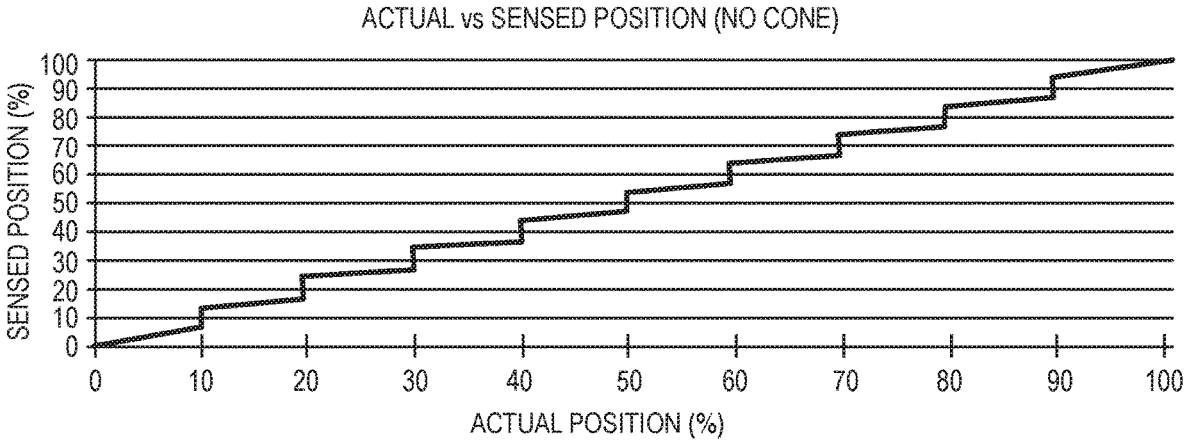
FIG. 5B shows a chart visualizing the effect.

FIG. 5A shows a position sensor assembly 144 measuring the position of shaft 131 using a light sensing element (e.g., photovoltaic cells) 148 and light source (e.g., light emitting element array) 150 as it moves back and forth in each stroke as indicated by arrow 154. When an array of light emitting elements is utilized (as opposed to a continuous light emitting element) a challenge of non-linearity of the sensor response exist. This is caused because most or all of the light from any single light emitting element (e.g., an LED) 152 is blocked after an amount of movement only slightly larger than the width of the light emitting element 152. The result is poor linearity in the sensed output relative to the actual position which manifests as a step change in position as each light emitting element is occluded. FIG. 5B shows a plot visualizing the non-linear response of the sensor.

Figure 6A:
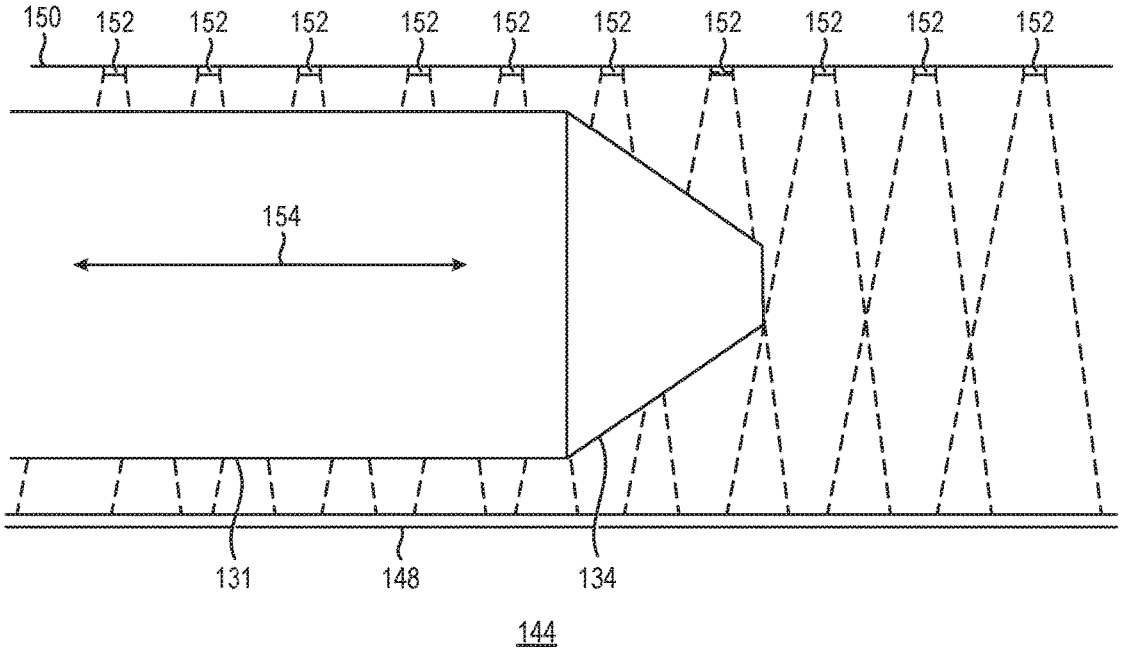
FIG. 6A shows another embodiment of the position sensor assembly 144 with a cone 134 positioned at the tip of the shaft 131.

The embodiment of FIG. 6A adds a cone to the shaft 131 to address this issue.

Figure 6B:
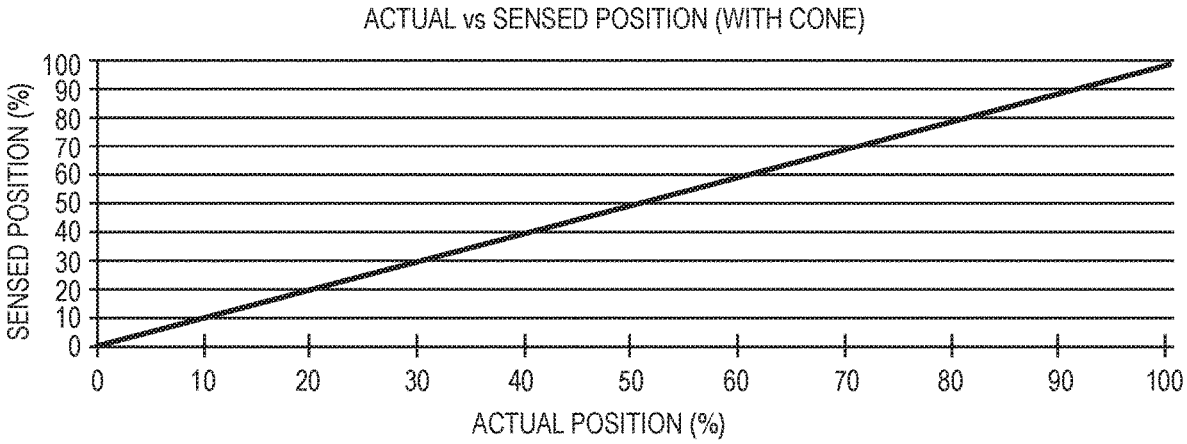
FIG. 6B shows a chart visualizing the effect.

FIG. 6A shows position sensor assembly 144 with a cone 134 located at the tip of the shaft 131 which is positioned between light sensing element 148 and light source 150 as it moves back and forth in each stroke of voice coil assembly 138 as indicated by arrow 154. The cone 134 passes back and forth between the light source 150 and the sensing element 148 along directional arrow 154. With the cone 134 on the shaft 131, the point of occlusion is further from the light emitting element 152. This has the advantage that the light from the light emitting element 152 is more gradually occluded as the shaft 131 moves because the spread of the beam from the light emitting element 152 is much wider at the point of occlusion. The current changes in proportion to the ratio of the cell area of the light sensing element 148 which is exposed to the light source 150 versus the ratio of the cell area which is occluded, with full current occurring when none of the cell is occluded and zero current occurring when the entire cell is occluded. By configuring the sensor arrangement such that complete occlusion of the cell is avoided during normal operation, the failure modes of a disconnected sensing element 148 or failure of the light source 150 can be detected. Benefits of this position sensor assembly 144 may include cost, cycle life, response time, and ability to operate within an electromagnetic field without influence on the light sensing element 148. In this way, a more linear relationship between actual position and sensed position is provided instead of step changes in the sensed as the shaft 131 moves back and forth and blocks individual light emitting elements 152. FIG. 6B shows a plot visualizing the improved response of the sensor with a cone 134 located at the tip of the shaft 131.

The position sensor assembly 144 allows the actuator 102 to produce arbitrary motion and air pressure profiles for user sessions that are selectable and controllable either before or during a session by an operator through an interface 105. As the shaft 131 moves back and forth along directional arrow 154, it causes the piston 126 and rolling diaphragm 128 to roll up and roll down to displace air in the air chamber 122. The air pressure can be calculated by measuring the actual voltage (and thus current) applied to the coil 140 to linearly move the voice coil assembly 138. In this way, motion, such as stroke, and changes in the air pressure can be controlled either individually or in concert with each other. The following are some of the benefits of the position sensor assembly 144. First, the position sensor assembly 144 works within the magnetic field formed by the magnet assembly 142 without being affected by it since it is using optical sensing. Second, the position sensor assembly 144 has a non-contact configuration so it does not wear out from repeated motion.

In an alternative embodiment, the position sensor assembly 144 could be made more accurate by compensating for the effect of temperature on the performance of the light emitting elements (e.g., LEDs) 152 and photovoltaic cells in the sensing element 148 (i.e., LEDs as they warm up will output less light and photovoltaic cells will output less current). This could be compensated for by having a reference sensor 153 (shown in FIG. 2 and FIG. 4) that is not occluded but in the same temperature environment as the position sensor assembly 144. The reference sensor 153 will help determine what the full scale value should be. The measured value is then scaled based on the reference sensor 153 rather than on a calibration value set only once at completion of position sensor assembly. In another alternative embodiment, the position sensor assembly 144 could have an operator triggerable calibration sequence where the operator might know that the outside environment has changed or there is some difficulty with the sensor (e.g., over or under-travel of the voice coil assembly 138). Such a sequence could re-calibrate the position sensor assembly 144 by driving the shaft 131 to its two extents (i.e., the two end points in a full stroke) to see what the actual measured range is and re-adjust its calibration based on the observed range of motion. These two alternative methods, together or individually, would help with the potential temperature resultant inaccuracy of the position sensor assembly 144.

Figure 7A:
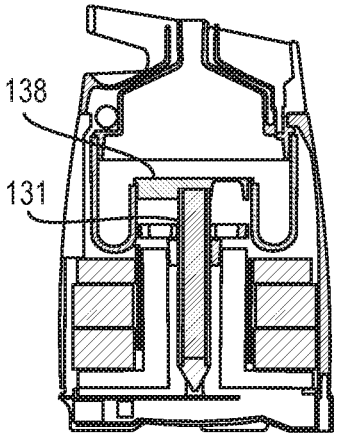
FIGS. 7A-7C show different operating positions of a voice coil assembly 138 made up of a piston 126, shaft 131 (with optional cone 134), support ring 132 (also optional), and coil 140 (e.g., voice coil).
Figure 7B:
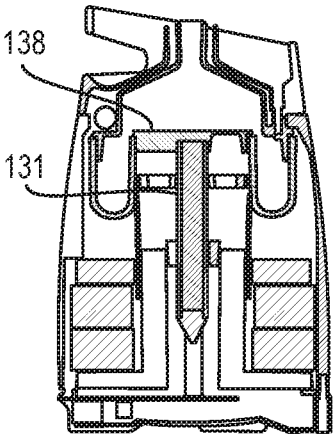
Figure 7C:
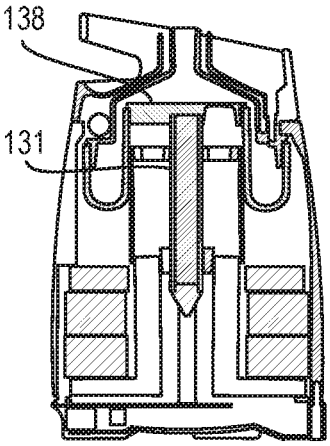

FIGS. 7A-7C show different operating positions of the voice coil assembly 138 having piston 126, shaft 131, support ring 132, cone 134, and coil 140. These elements of the voice coil assembly 138 will all move together in a substantially linear direction up and down in the area 130 around the shaft 131 of the actuator 102 to change the air pressure and volume of air in the air chamber 122. FIG. 7A shows the positioning assembly in a fully down (or bottom) position. FIG. 7B shows the voice coil assembly 138 in mid-position. FIG. 7C shows the voice coil assembly 138 in a fully up (or top) position. As used herein, the term "stroke" is the full distance of the travel of the voice coil assembly 138 as it travels the distance from fully down in FIG. 7A to fully up in FIG. 7C. This distance may be approximately 2 to 4 inches. As discussed above, the air chamber 122 is the volume of air enclosed by the piston 126, rolling diaphragm 128, and air chamber piece 123. At the bottom of the stroke shown in FIG. 7A, the enclosed volume of air is at its largest which means it has sucked all the air into it and thus all the air out of the attached stimulation device (e.g., receiver 104). As the voice coil assembly 138 transitions from fully down position to the fully up position it pushes the air out of the air chamber 122 of the actuator 102 and into the stimulation device (e.g., receiver 104) which, in some embodiments, inflates a receiver sleeve 166 of the receiver 104 (to be discussed below in detail).

The air chamber 122 pressure is measured as a force applied over the area of the piston 126 and rolling diaphragm 128. This force is applied by the voice coil assembly 138. The voltage applied to the coil 140 is $V_{coil}$=duty cycle (D) of the pulse width modulation (PWM) signal from the actuator controller 146 X $V_{supply}$ as measured by the actuator controller 146. From this, with the resistance of the coil known, the current and thus the applied force of the voice coil assembly 138 may be determined. The actuator controller 146 can automatically detect, based on air pressure in air chamber 122 and position of the shaft 131, whether the shaft 131 has reached the end of a stroke for a stimulation device (e.g., receiver 104). The actuator 102 can then automatically stop the shaft 131 there and reverse direction. If the measured stroke extents are not centered within the stroke range of the piston 126, the valve 124 can be operated to adjust the air volume in the closed air circuit such that full stroke capability of the piston 126 is available to the operator of the actuator 102. In this way, the actuator 102 provides dynamic adjustment in session of the stroke length of the voice coil assembly 138 to accommodate the length and girth of a male member 170 (e.g., penis) as the level of arousal or penetration varies for an operator of the receiver 104. Also, the automatic detection of the end of stroke prevents the receiver 104 from being over-driven and pushing itself off the operator. In addition, the operator can manually control the stroke length (in session). The dynamic adjustment and automatic end of stroke detection is achieved by at least two functions. First, actuator controller 146 uses software stored in memory (discussed below in the description of FIG. 25) to detect patterns in the pressure and position of the shaft 131 which correspond to driven movement near the extents of the stroke travel of the shaft 131. Second, as will be discussed below in relation to the discussion of receiver 104, a unique profile of the receiver seal 164 at the entrance of the receiver 104 enhances the ability for the software in the actuator controller 146 to detect stroke extents appropriate for the individual user. The configuration of the receiver seal 164 at the entrance of the receiver 104 may also be able to prevent the receiver 104 from pushing itself off of the operator's male member by maintaining an air-tight seal around the penis even when the sleeve/liner is fully inflated. This is a mechanical method of preventing this undesirable mode of operation and may be used by itself or in concert with dynamic stroke length adjustment. In an alternative embodiment, the support ring 132 may be optional in the voice coil assembly. The piston 126 and coil 140 could be constructed as an integrated unit. The shaft 131 could also be omitted by making the coil 140 itself a bearing surface or integrating the linear guide function of the shaft into the piston. In such an embodiment, the position sensor assembly would be occluded by the coil body itself.

Figure 8A:
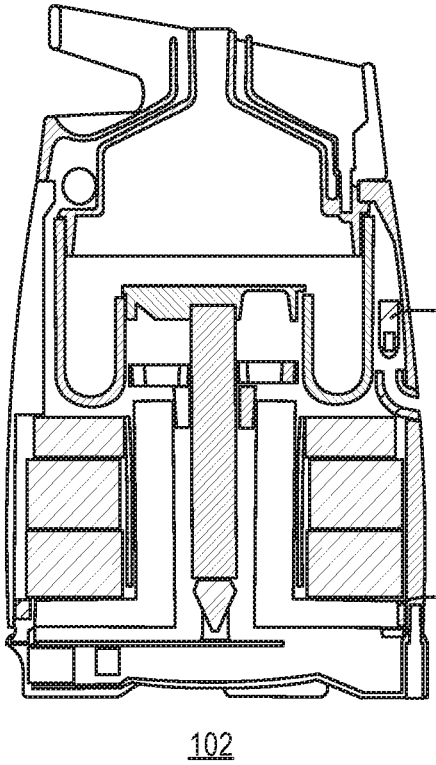
FIGS. 8A-8B illustrate an alternative cross-sectional view of the actuator 102 with a second valve 178 (e.g., air spring valve).
Figure 8B:
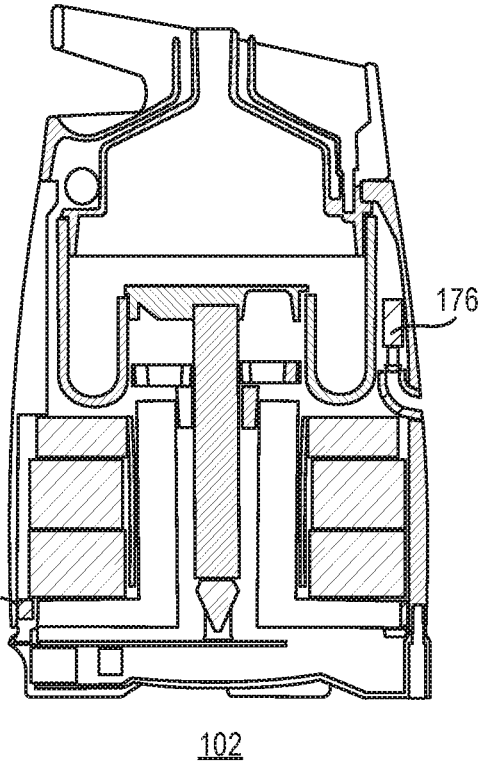

FIGS. 8A-8B show an alternative embodiment of the actuator 102. A mechanical coil and/or air spring may be used to enable the pressure in the closed air circuit to be substantially higher or lower than ambient pressure (a pressure offset). When an air spring is employed, its effect may be applied or disabled by a second valve such as an air spring valve 176. Pressure offsets above ambient pressure may be useful where no negative pressure is required, such as insertable devices instead of receivers. Pressure offsets below ambient pressure may be useful when additional negative pressure is desired by the operator. If it is desired to have the device operate with a pressure offset in the "closed air circuit" including the air chamber 122, hose 108, and receiver 104, an air spring valve 176 can be used for this purpose. The air spring valve 176 is shown open in FIG. 8A and closed in FIG. 8B. A pressure offset may also be desirable when a constant force is applied to the receiver 104 or insertable device 109. An example may be a insertable device 109, when inserted, requiring a constant pressure to overcome the tightness of the operator, allowing it to hold its shape and size against that externally applied pressure. This pressure offset is not always desired, however, so it is advantageous to be able to select when such a function is desired and to what extent. The air spring may take the form of a sealed volume on the outside (i.e., opposite the closed air circuit) of the piston 126 and rolling diaphragm 128. The air spring valve 176 is used to selectively seal or vent this volume of air to atmosphere and in this way the air spring effect can be activated and deactivated. The position of the voice coil assembly 138 at the time that the air spring valve 176 is closed determines the position corresponding to the new neutral pressure (i.e., the position in which the voice coil assembly 138 will come to rest when no force is applied by the coil 140). The air spring valve 176 may be closed before the external pressure is applied, or the voice coil assembly 138 may temporarily provide the desired pressure, during which the air spring valve 176 is closed (as shown in FIG. 9B). The voice coil assembly 138 may then be de-energized, allowing the air spring to continue applying a force on the rolling diaphragm 128 and piston 126, and thus a baseline pressure in the closed air circuit. By removing the burden of providing this pressure from the voice coil assembly 138 and allowing it to be de-energized, excessive heating of the coil 140 due to the current required to maintain a constant non-zero force can be prevented.

Returning to FIG. 1, the actuator 102 is pneumatically connected through hose 108 to receiver hose port 156 of receiver 104. Hose 108 may be a large diameter in the range of approximately ⅝ inch to 1.5 inch. Using a hose diameter in this range allows a transfer function which would allow an upper frequency of approximately 30 Hertz (Hz) (or potentially higher to 50 Hz). The large diameter keeps the air velocity lower with less inertia to it. In this way, the large diameter allows for the transmission of higher content frequency from the actuator 102 to the receiver 104 as higher frequencies require more rapid changes of air velocity in the hose 108. A smaller diameter hose could dampen out the high frequency because velocity of the air in the hose 108 would be too high to quickly change direction. Too narrow of a diameter of hose 108 has the effect of a low-pass filter on the motion of the receiver 104. The low frequency component of the motion would make it through but the high frequency component would not make it to the receiver 104.

Figure 9:
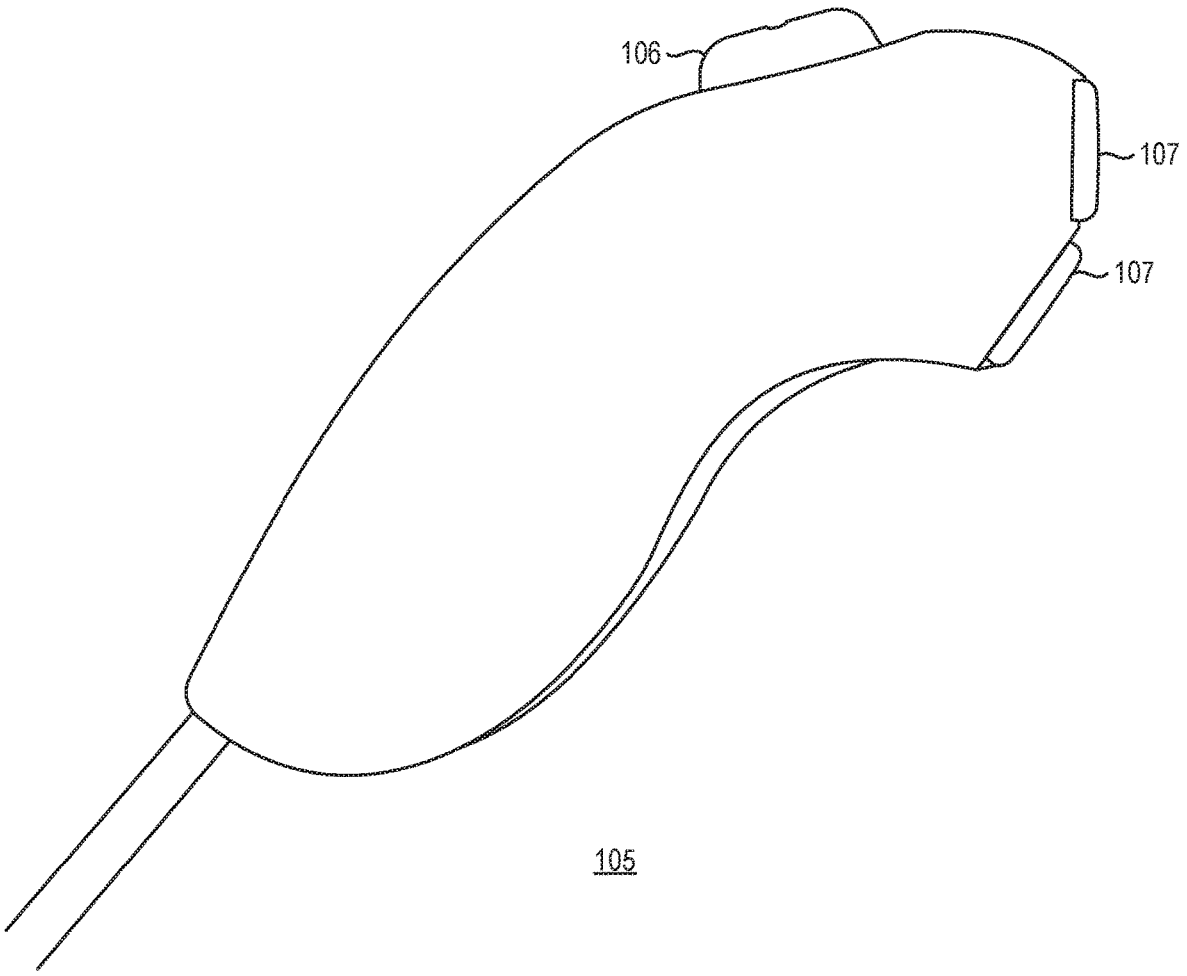
FIG. 9 shows a perspective view of an interface (or actuator control device) 105.

FIG. 9 shows a detailed view of an interface 105. Interface 105 can be hard wired to the actuator 102 through connection line 112. In an alternative embodiment, connection line 112 can be a wireless link from the interface 105 to the actuator controller 146. The connection could be Zigbee, WiFi, Bluetooth, 4G, and/or 5G. In other alternative embodiments, the function of the control device 105 could be performed by a wireless mobile device (e.g., an iPhone), a personal computer (reference 298 shown in FIGS. 21-24) and/or a virtual reality device 300. The interface 105 may have a rotary encoder with button 106 and a plurality of different adjustment (or parameter) inputs 107 (e.g., buttons) having settings such as force values and speed to control the actions of the voice coil assembly 138 in actuator 102 and the resulting pneumatic output of the actuator 102.

Figure 10A:
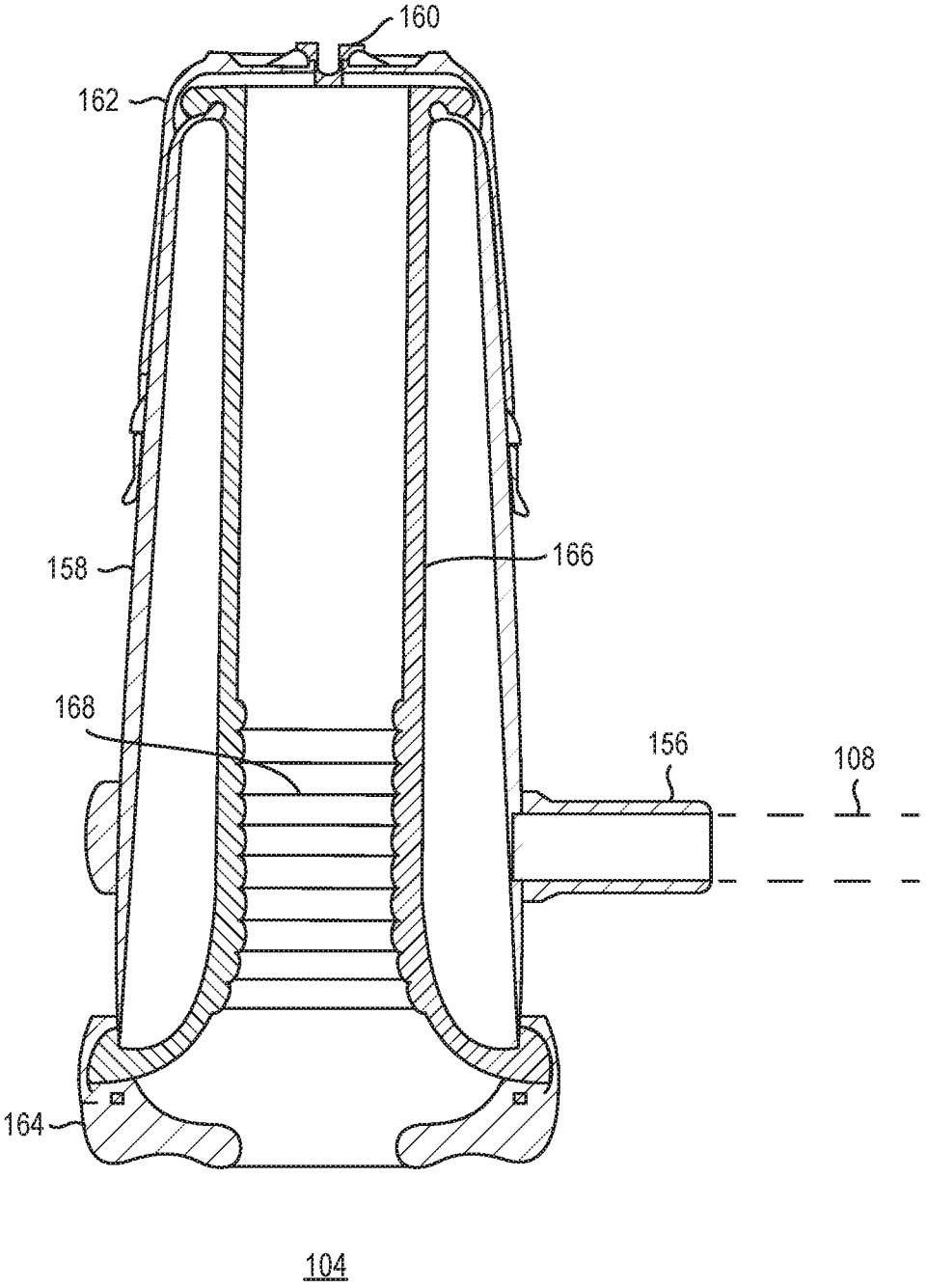
FIG. 10A shows a cross-sectional view and FIG. 10B shows an exploded view of a receiver 104.
Figure 10B:
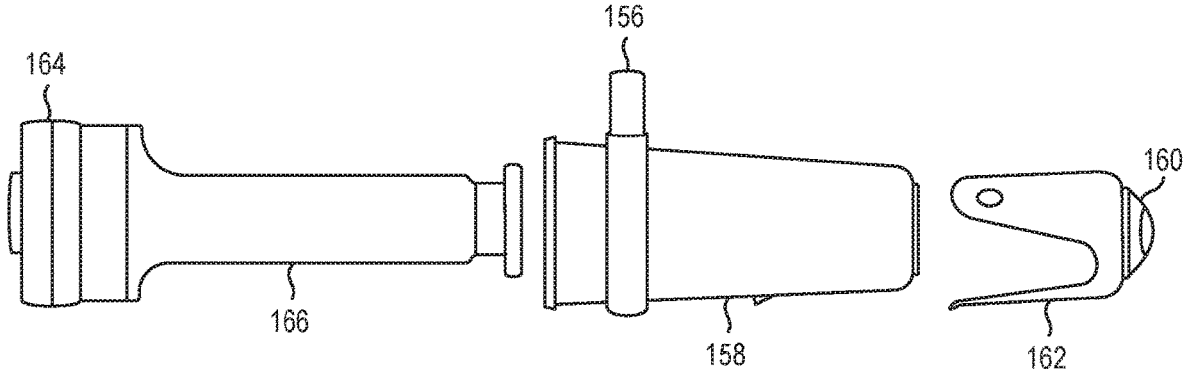

A detailed view of receiver 104 is shown in FIG. 10A and an exploded view of the receiver 104 is shown in FIG. 10B. Receiver hose port 156 is attachable to hose 108. The receiver hose port 156 allows pressured air from hose 108 access to rigid housing 158. Rigid housing 158 can be made of a durable plastic material and is substantially airtight to the receiver sleeve 166 except for the receiver hose port 156. Receiver one-way valve 160 in receiver cap 162 allows excess air in the receiver sleeve 166 to be expelled. Receiver cap 162 and receiver seal 164 can be snapped on or off which will allow receiver sleeve 166 to be slid in and out of the housing 158. This allows for easy changing and easy cleaning of the receiver sleeves 166 and avoids having to stretch the receiver sleeve 166 for installation as on existing devices. In position, cap 162 forms a seal with the receiver sleeve 166 by pinching the top of the receiver sleeve 166 between the cap 162 and the housing 158 to form an airtight seal. On the opposite end of the receiver 109 is a receiver seal 164. In position, receiver seal 164 forms a seal with the receiver sleeve 166 by pinching the bottom of the receiver sleeve 166 between the seal 164 and the housing 158 to form an airtight seal. The receiver sleeve 166 may have a plurality of different internal shapes. For example, the receiver sleeve 166 may have "molded-in" sleeve texture 168. Sleeve texture could take the form of varied surface finish on the sleeve interior surface (e.g. smooth or rough), internal protrusions or recesses of a variety of profiles (e.g. internal ribs, ridges, or bumps), or any combination of these textures on the interior of the receiver sleeve 166. The sleeve 166 may be made of silicone to avoid allergies to latex and allow ease of casting texture 168. The sleeve texture 168 may be located in different parts of the sleeve 166 (or running along the entire full length of the sleeve 166). The diameter of the installed receiver sleeve 166 can vary and still able to fit within the same housing 158. The receiver sleeve 166 hardness can also vary. The cap 162 pinches the sleeve between itself and the rigid housing 158. The receiver seal 164 with an integrated retainer ring pinches the other end of the receiver sleeve 166 between the rigid housing 158 and itself creating annular air volume that is sealed except for the hose port 156. The seals 164 may come in a plurality of different sizes (e.g., four) depending on the girth of the operator attempting to obtain airtightness.

Figure 11A:
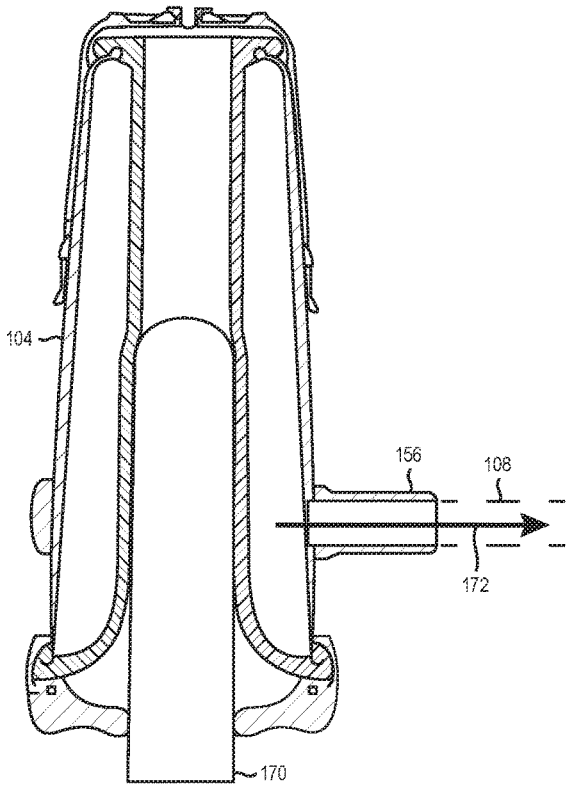
FIGS. 11A-11B show receiver 104 in operation.
Figure 11B:
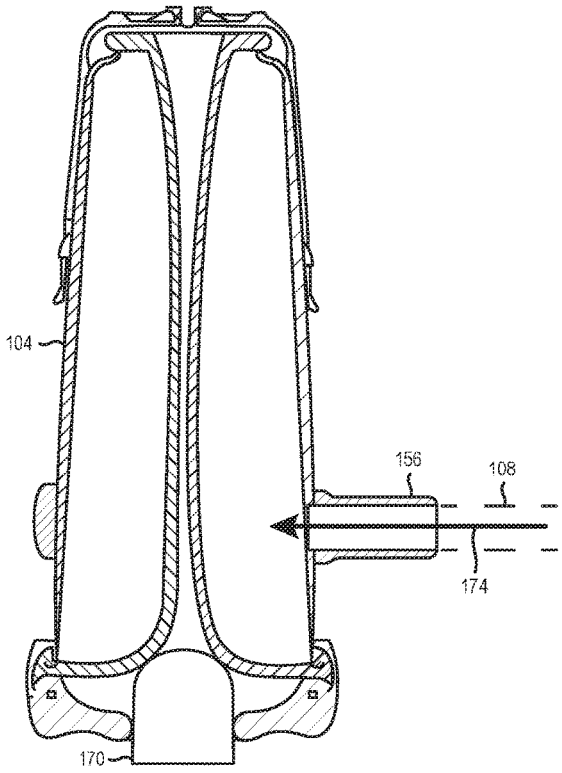

FIGS. 11A-11B show operation of the receiver 104. FIG. 11A shows a male member 170 in fully deflated receiver 104 with the air pulled out through receiver host port 156 indicated by arrow 172. FIG. 11B shows the male member 170 fully outside the sleeve 166 with the receiver seal 164 maintaining air tightness and the arrow 174 showing the air pushed in through receiver hose port 156. This represents the top of the stroke. This is one extent of the stroke of the receiver on the operator. This may or may not correspond to the extents of stroke of the voice coil assembly, which is why dynamic stroke length and adjustment of the volume of air in the closed air circuit (via the valve 124) is important. Because air tightness is retained between the male member 170 and the seal 164, and the male member 170 is not expelled from the seal 164 in this position, as the stroke changes direction the member is drawn back into the sleeve 166.

Figure 12A:
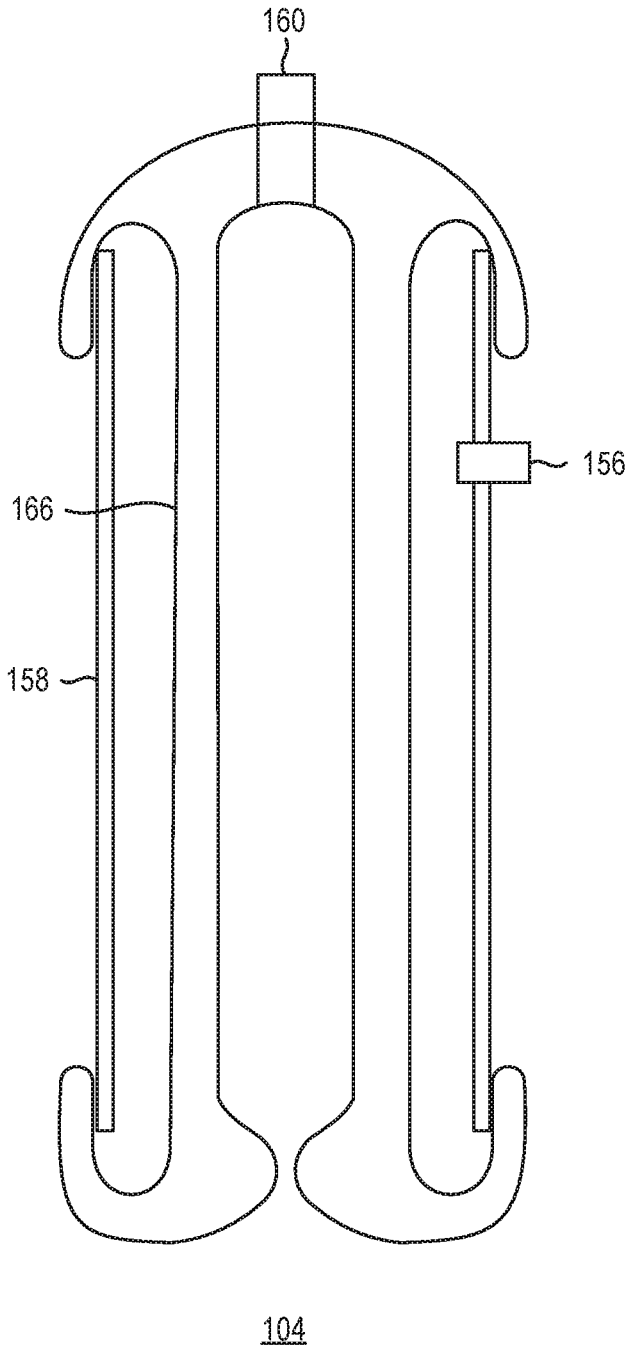
FIGS. 12A-12D show alternative embodiments of the receiver 104.
Figure 12B:
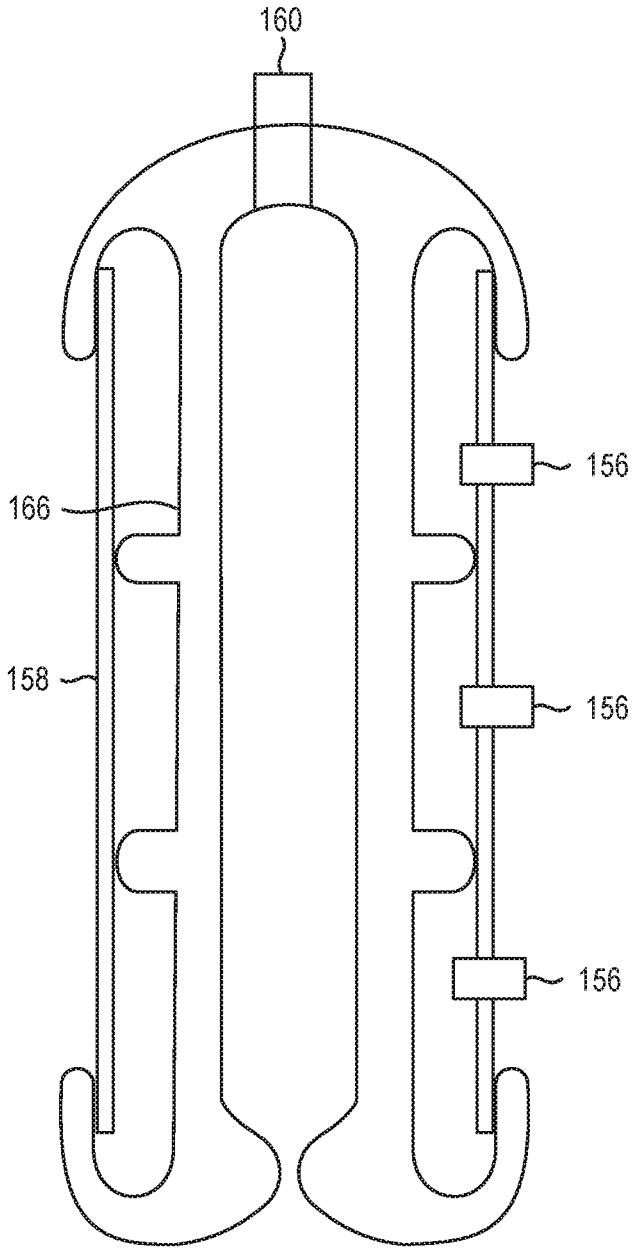
Figure 12C:
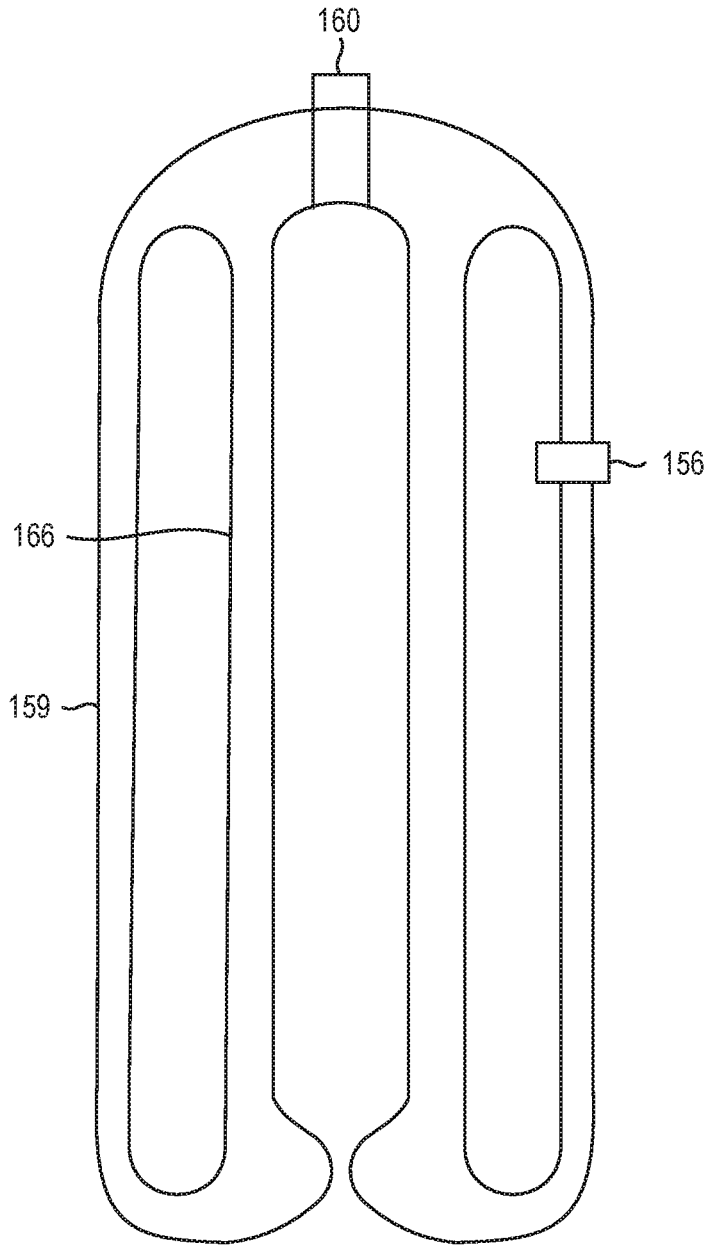
Figure 12D:
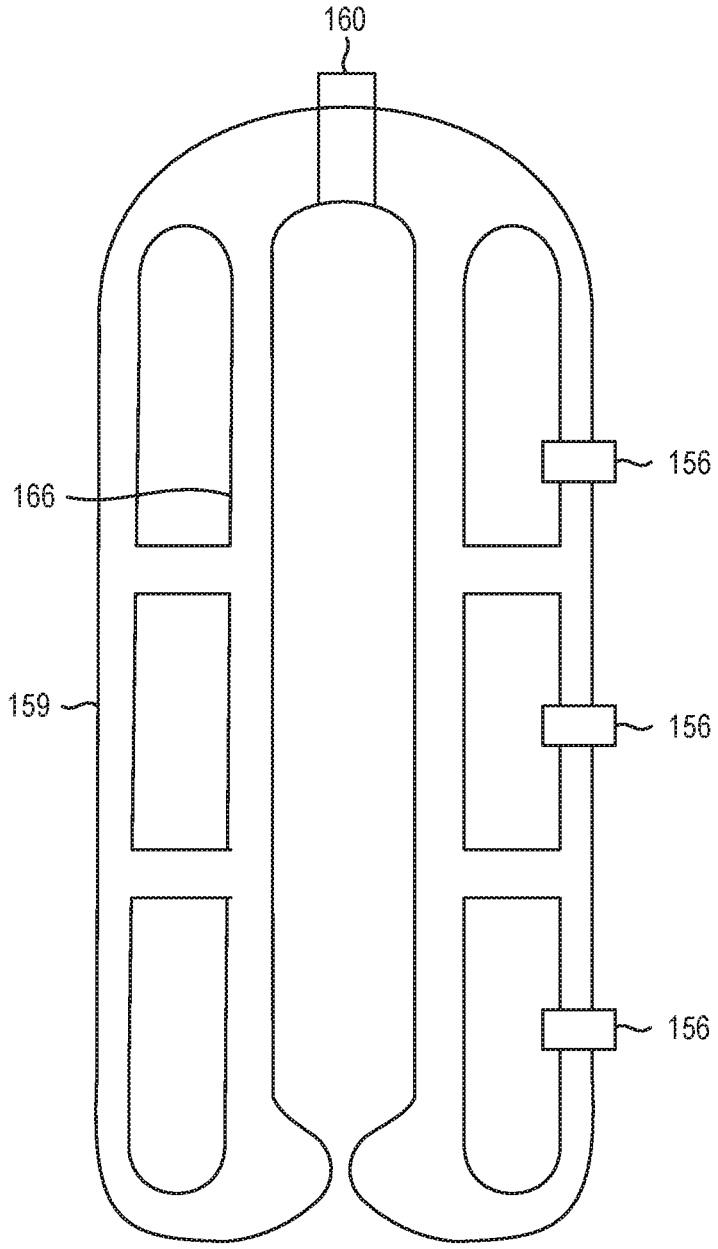

FIGS. 12A-12D show alternative configurations of the receiver 104. FIG. 12A illustrates an exemplary cross section view of a rigid outer housing 158 a soft elastic receiver sleeve 166, one air chamber with a receiver hose port 156 for connecting with the actuator 102 and receiver one way valve 160. FIG. 12B illustrates an exemplary cross section view of a rigid outer housing 158 a soft elastic receiver sleeve 166, plurality of air chambers (e.g., three) with receiver hose ports 156 for connecting with a plurality of separately controllable actuators 102 (e.g., three). FIG. 12C illustrates an exemplary cross section view of a receiver with a soft elastic housing 159 having integrated receiver sleeve 166 and one air chamber for connecting with an actuator 102. FIG. 12D shows an exemplary cross section view of a receiver with a soft elastic housing 159 and an integrated receiver sleeve 166 with three separate air chambers and corresponding receiver hose ports 156 for connecting with one or more separately controllable actuators 102.

Figure 13A:
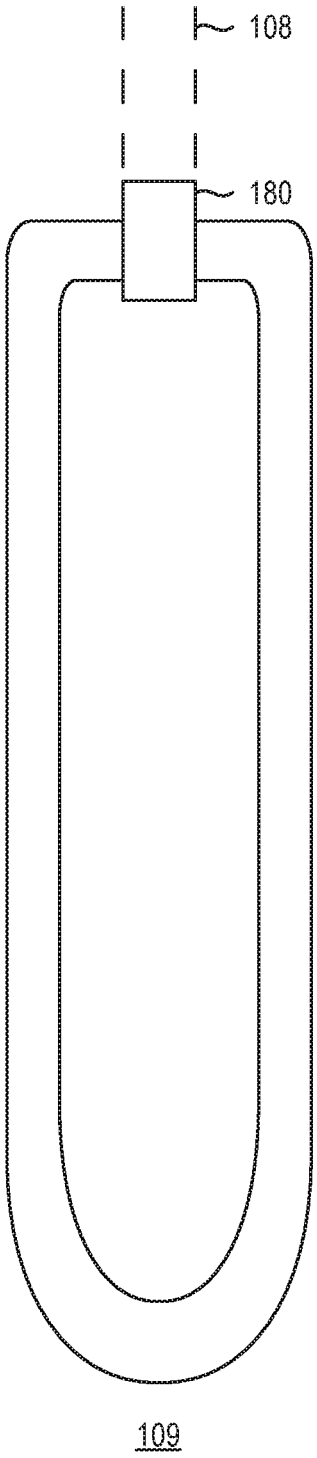
FIGS. 13A-13B show alternative configurations of an inflatable insertable device 109.
Figure 13B:
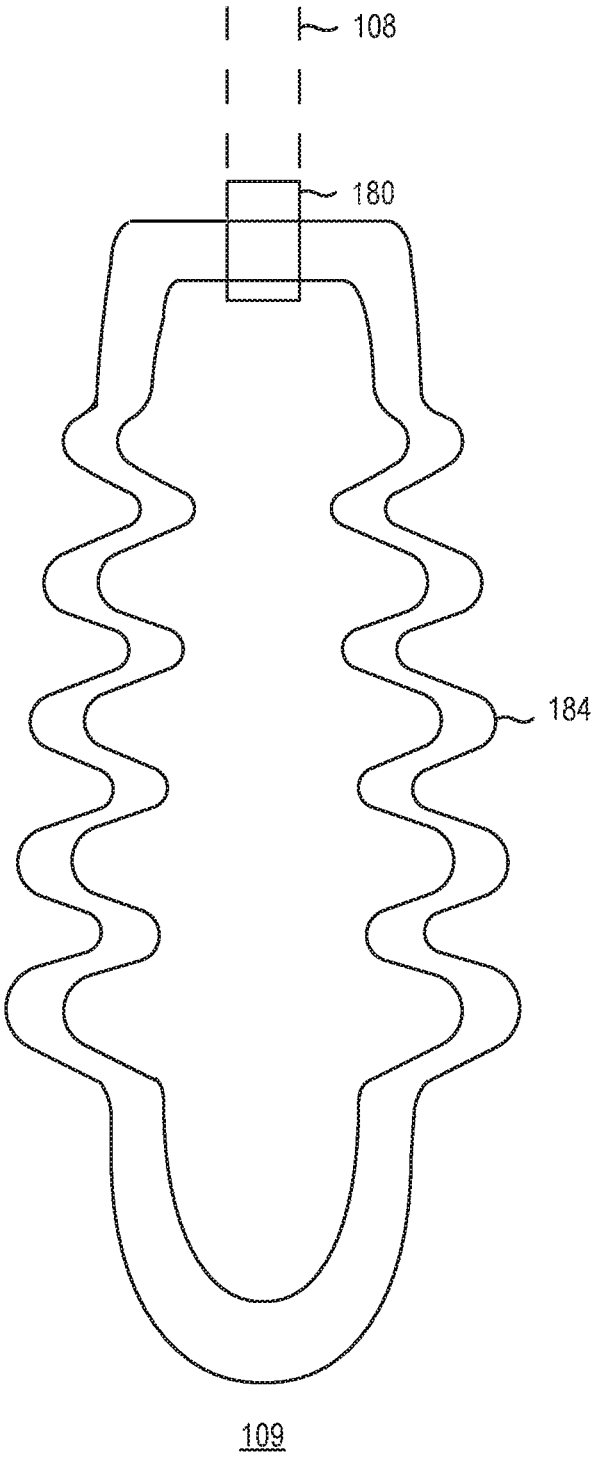

FIG. 13A illustrates an exemplary cross section view of insertable device 109 for connecting with actuator 102 having an insertable device hose port 180 for hose 108. FIG. 13B shows an exemplary cross section view of an articulating insertable device 109 with an insertable device hose port 180 at one end for connecting with the actuator 102. Articulation is achieved by extension and retraction of the bellows 184.

Figure 14:
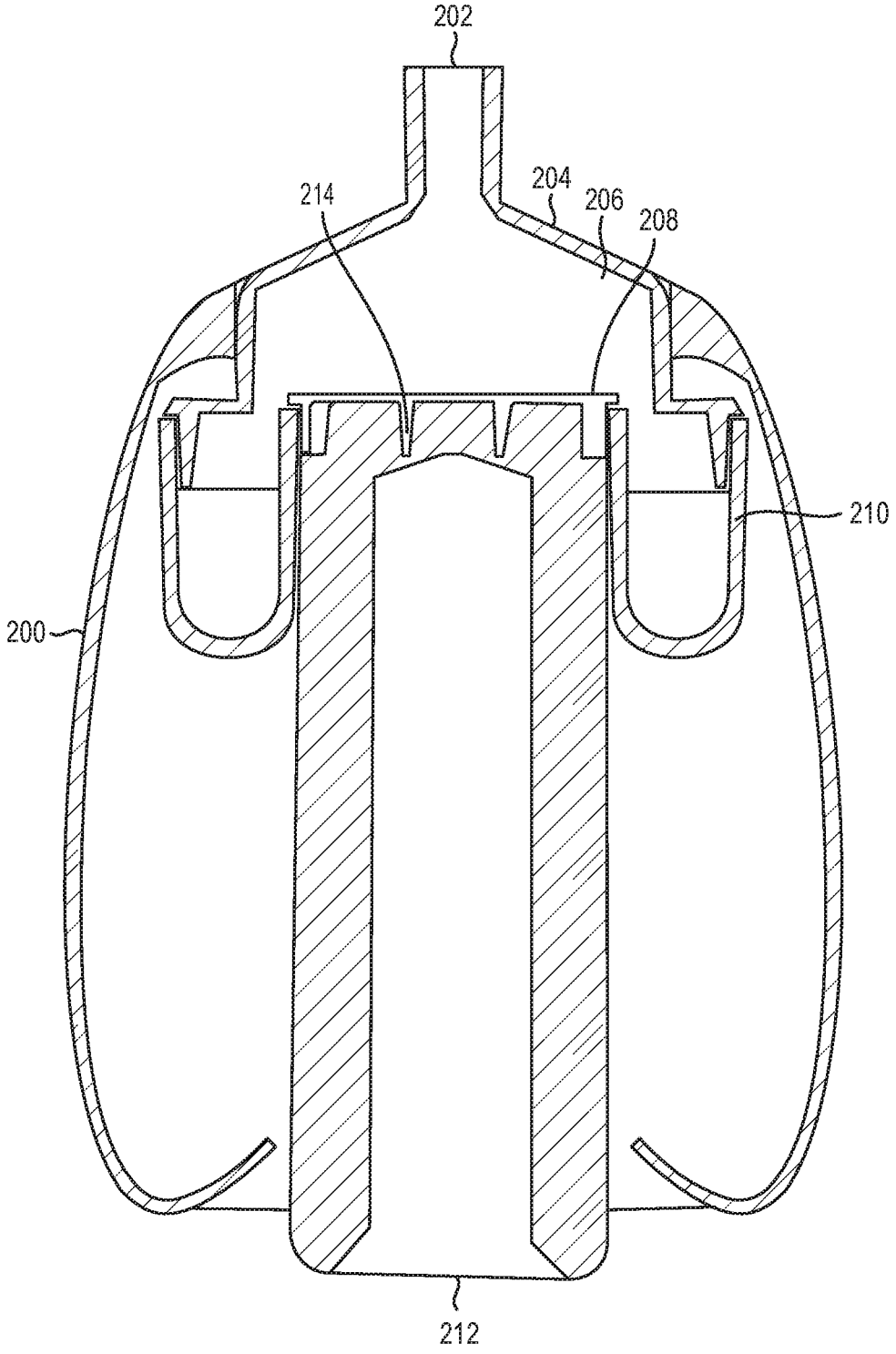
FIG. 14 shows a cross-sectional view of actuated tube device 110.

FIG. 14 shows a cross-sectional view of actuated tube device 110 for male use. The device 110 has a housing 200, hose port 202, top portion 204 forming an air chamber 206 with piston 208 and rolling diaphragm 210. Tube 212 is mounted inside the housing 200 on the piston 208 and between the sides of the rolling diaphragm 210. Detachable mount 214 holds the tube 212 in place on the piston 208. The tube 212 is detachable and replaceable. In this embodiment, the motion of the tube 212 is substantially linear translation as opposed to change of shape due to inflation and deflation as in the receiver 104 and inflatable insertable device 109.

Figure 15:
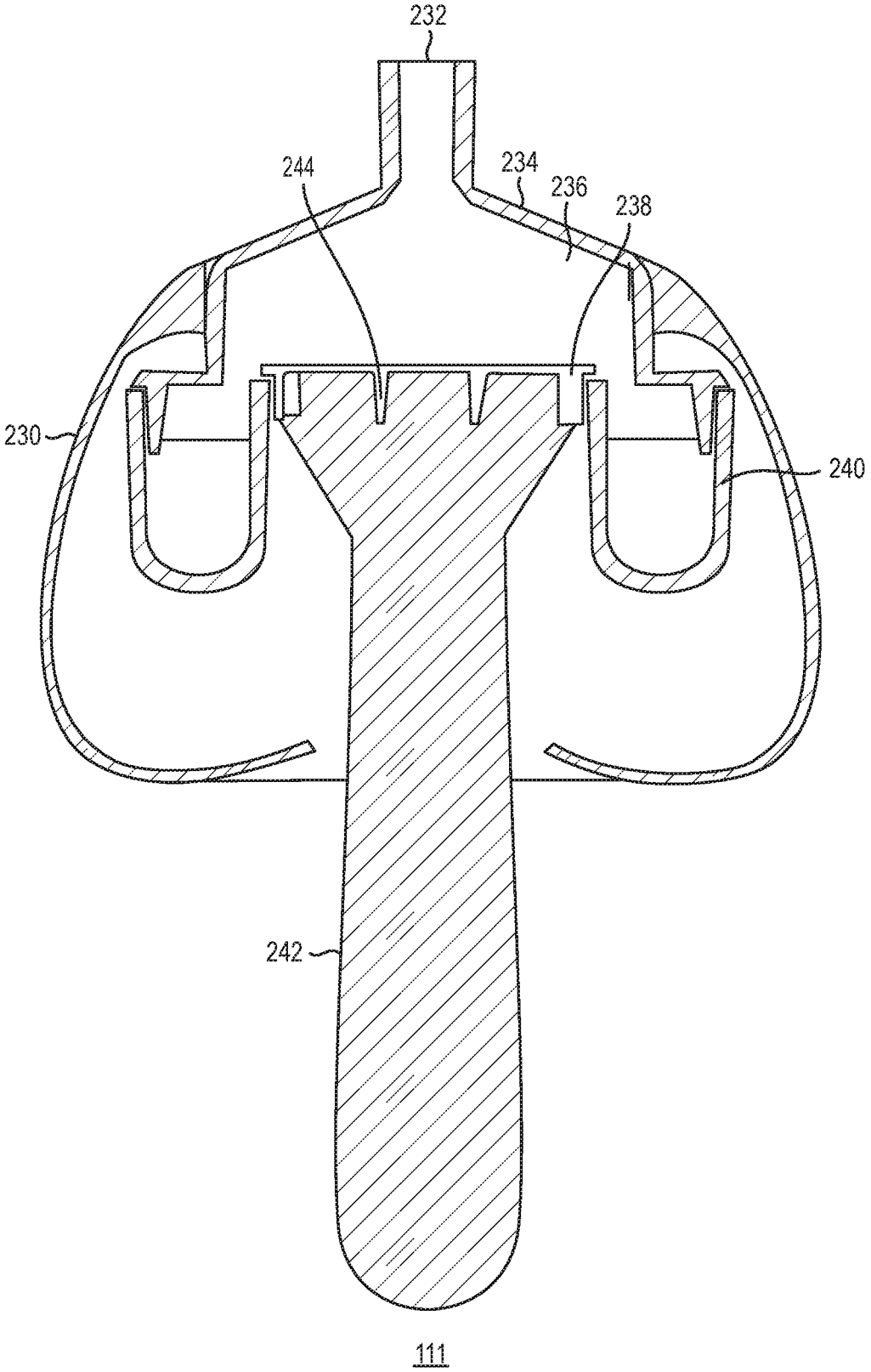
FIG. 15 shows a cross-sectional view of actuated insertable device 111.

FIG. 15 shows a cross-sectional view of actuated insertable device 111 for insertable use such as a dildo. The device 111 has a housing 230, hose port 232, top portion 234 forming an air chamber 236 with piston 238 and rolling diaphragm 240. Insertable device (or dildo) 242 is mounted in the housing 200 on the piston 238. Detachable mount 244 holds the insertable device 242 in place. The insertable device 242 is detachable and replaceable. In this embodiment, the motion of the insertable device 242 is substantially linear translation as opposed to change of shape due to inflation and deflation as in the receiver 104 and inflatable insertable device 109.

As well as for a receiver 104 and insertable device 109, the actuator 102 can be used to drive tube actuated device 110 and actuated insertable device 111. In these embodiments, the tube actuated device 110 or insertable actuated device 111 would be driven in a translating motion by the varying air pressure in the closed air circuit by pistons (208, 238) and rolling diaphragms (210, 240) which would connect to the hose 108 shown in FIGS. 1C and 1D in place of the receiver 104. The areas of the pistons (208, 238) and rolling diaphragm (210, 240) can be the same size, larger, or smaller than the corresponding piston 126 and rolling diaphragm 128 in the actuator 102. Different sized pistons and diaphragms will result in different stroke length and force capabilities at the actuated end. Pistons and diaphragms larger than those in the actuator 102 will result in an actuated device with a shorter stroke but more force, and vice versa. As discussed above, in alternative embodiments, the diaphragms could be replaced by sliding dynamic seal piston and cylinder pair of sufficiently low friction.

Figure 16A:
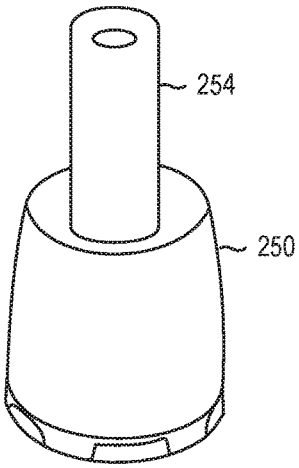
FIGS. 16A-16C show tube direct mount actuator 250 with a mount 252 for a tube 254 installed directly on the voice coil assembly 138 to produce similar results of the actuator 102 without a closed aft circuit.
Figure 16B:
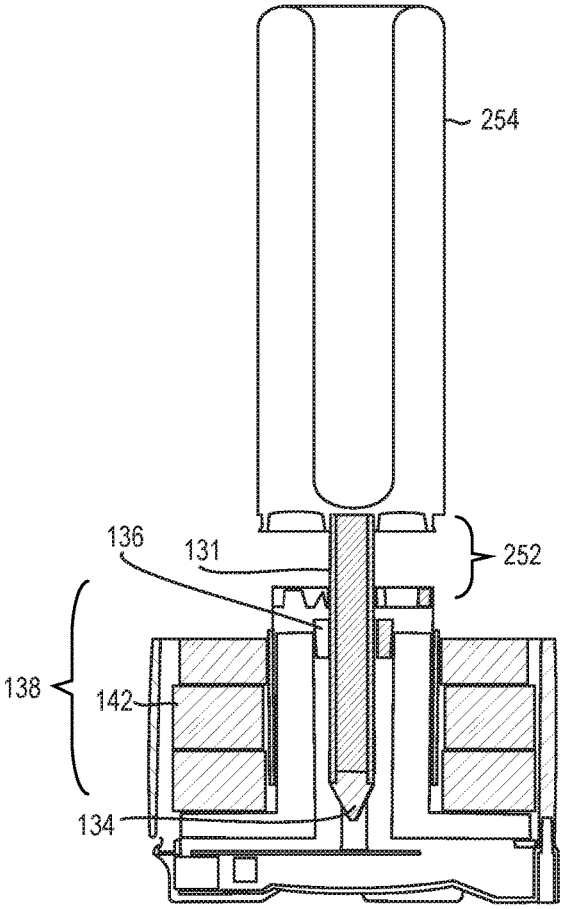
Figure 16C:
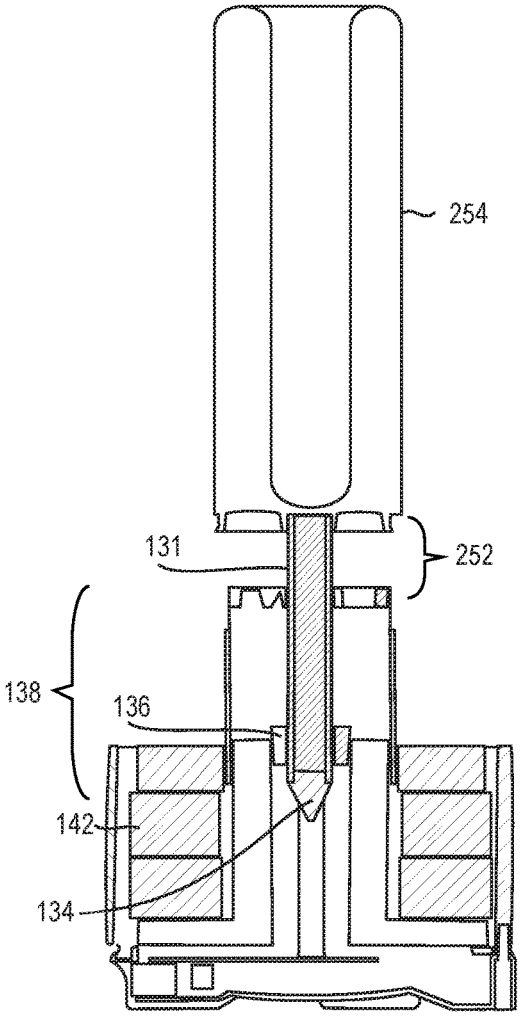

FIGS. 16A-16C illustrate a tube direct mount actuator 250 with a mount 252 for a tube 254 installed directly on the voice coil assembly 138 to produce similar results of the actuator 102 without an air circuit. The elements of FIGS. 16A-16C function very similarly to the correspondingly labeled elements of the actuator 102 shown in FIG. 2.

Figure 17A:
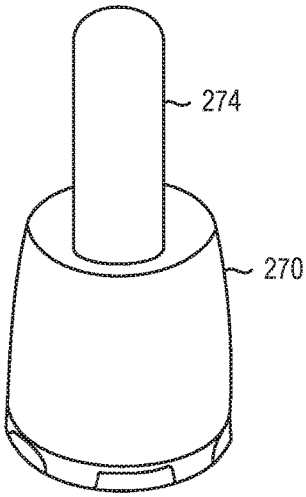
FIGS. 17A-17C show an insertable device direct mount actuator 270 with a mount 272 for an insertable device 274 installed directly on the voice coil assembly 138 to produce similar results of the actuator 102 without a closed air circuit.
Figure 17B:
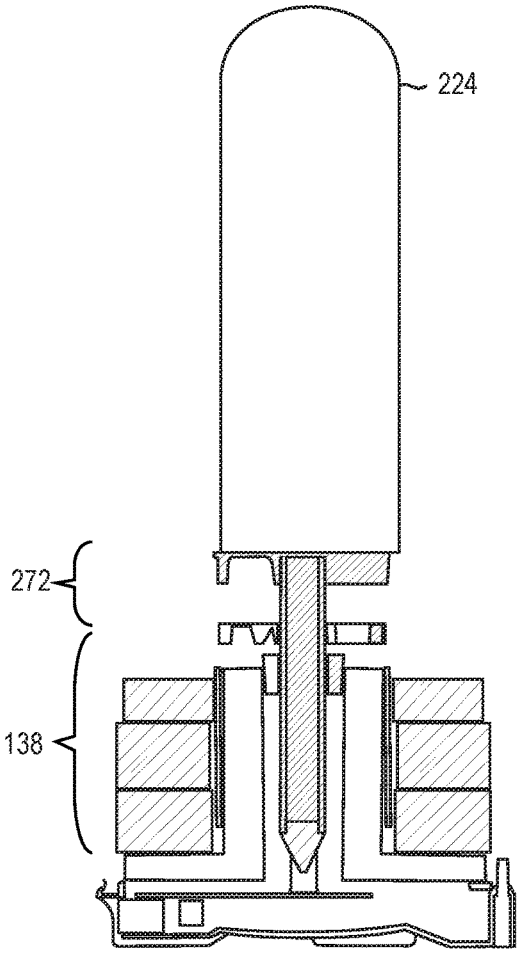
Figure 17C:
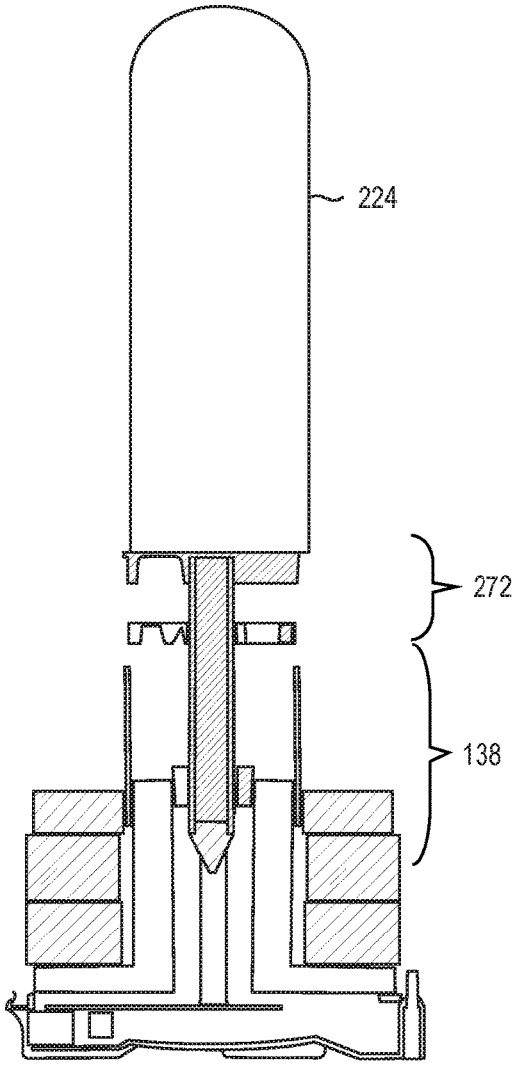

FIGS. 17A-17C shows a insertable device direct mount actuator 270 with a mount 272 for a insertable device (or dildo) 274 installed directly on the voice coil assembly 138 to produce similar results of the actuator 102 without an air circuit. The elements of FIGS. 17A-17C also function very similarly to the correspondingly labeled elements of the actuator 102 shown in FIG. 2.

Figure 18A:
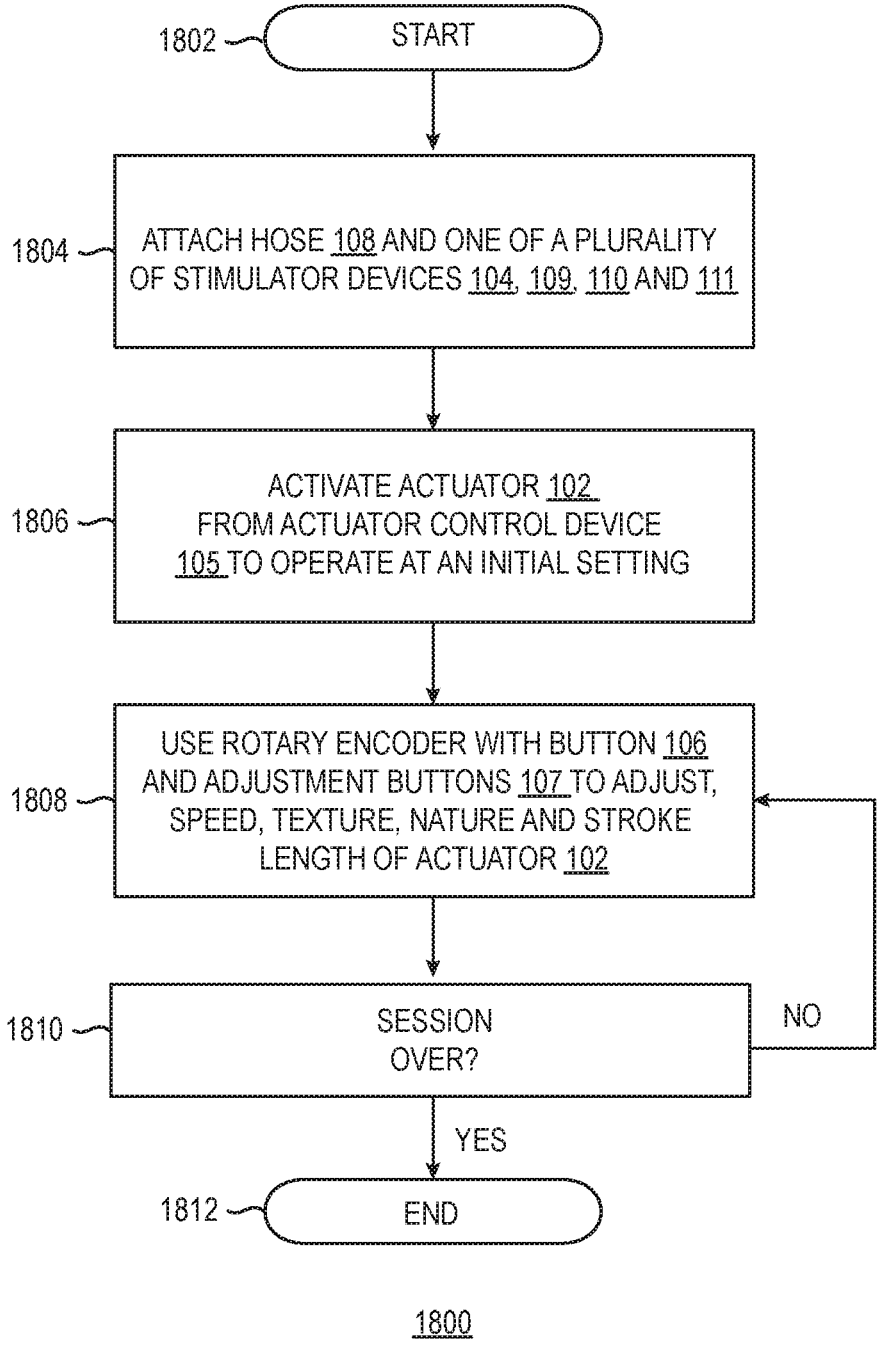
FIG. 18A shows a flowchart 1800 demonstrating operation of the actuator 102 in a typical session and FIG. 18B shows a flowchart of the actuator 102 operating in an alternative session.

FIG. 18A shows a flowchart 1800 demonstrating operation of the actuator 102 in a typical session. Operation of the actuator begins in step 1802. The operator attaches hose 108 between actuator 102 and one of a plurality of stimulation devices such as receiver 104, insertable device 109, actuated tube device 110, actuated insertable device 111 or the like in step 1804. In step 1806, actuator 102 is activated by the operator through interface 105 to operate at initial settings. Rotary encoder 106 and adjustment buttons 107 may be used to adjust the initial settings in step 1808. The rotary encoder (e.g., a wheel) 106 can either be used to make fine adjustments by turning the wheel one tick at a time or by turning the rotary encoder 106 faster the selected parameter will change faster. Lights (not shown) on interface 1804 will display the current settings. Parameters for operation of the actuator 1802 may include speed, texture, nature and stroke length. Speed shall mean the rate of operation of the actuator 102. Texture shall mean additional stimulation combined with the stroking motion. Nature shall mean the style of the texture. By adjusting the nature the operator can speed up or slow down the frequency of the texture. Turning nature almost all the way to the bottom with the texture set to about half will cause an interference pattern. The stroking motion will fade in and out. Stroke length referring to the movement of the voice coil assembly 138. The amount air into and amount of air out of the actuator 102 may be controlled. There is also a pause button. Parameters can also be adjusted while the actuator 102 is not active. This allows for stopping and restarting with different stimulation settings. In step 1810, over the operator may choose to end the session. If "no", the session proceeds. If "yes", the session ends in step 1812.

Figure 18B:
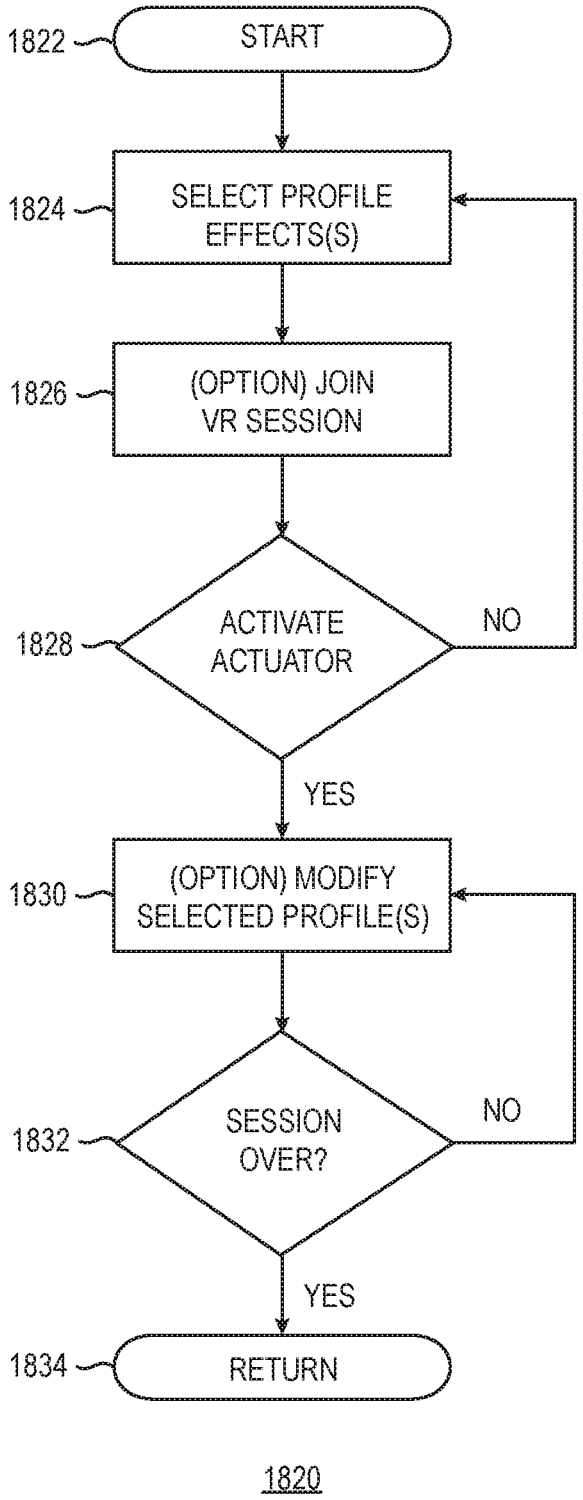

FIG. 18B shows an alternative session in flowchart 1820. The alternative session starts in step 1822. In step 1824, similar to flowchart 1800, profile parameter effects are selected. In step 1826, an option is provided to join a virtual reality session. In step 1828, the actuator 102 is activated. In step 1830, an option is provided to modify the selected profile parameters through interface 105. In step 1832, it is determined if the session is over. In step 1834, the flowchart returns to the start 1822.

One of the benefits of the configuration of parts of the actuator 102 is that the resulting air pressure produced is not limited to a sinusoidal motion and can allow for adjustment of the stroke length of the piston 126 in real-time. For example, the shaft 131 does not have to drive the entire stroke length but can be set to any point on the linear path in the area 130 around the shaft 131. This allows for adjustment of the amplitude or length of the stroke in real time. Because a voice coil assembly 138 is used, force can be controlled as well in the actuator 102. For a given voltage applied to the coil 140, a fixed current will flow resulting in a fixed force. That force applied over an area is a pressure. Some user preferences or applications may require that a position command (e.g., go to position 1000) be achieved with less than the full available force. The actuator controller 146, knowing the applied voltage, thus coil current and resulting force, is able to limit the applied voltage as per the user preference or external setpoint. For example, information such as position and force of the operator in the receiver 104 can be translated back to actuator 102. This information can then be transmitted to another user on another stimulation device (whether local or remotely over a network). Internal variables used in the closed loop position control are available to the controller 146 for internal use or transmission to another device. The output of the control loop is the voltage, and thus force. When used with a complementary device, video or game, this force might be used in a variable amount and synchronized with the complementary device, video or game to apply greater or lesser force.

Figure 19A:
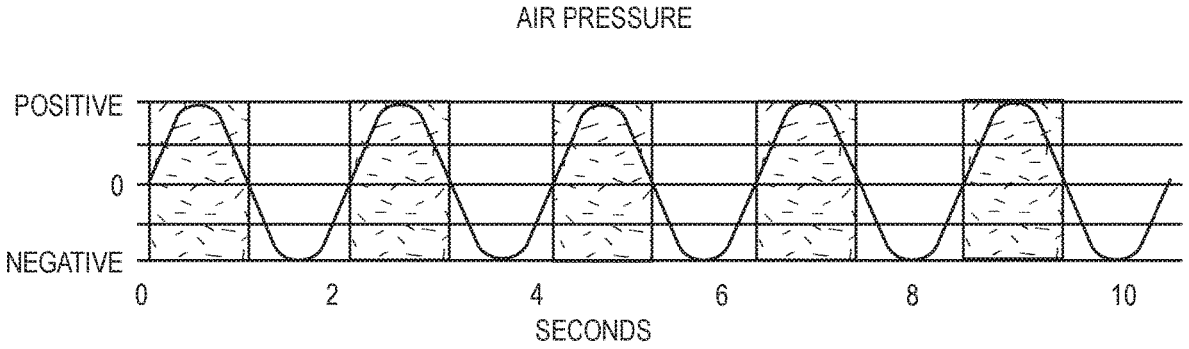
FIGS. 19A-19B illustrate exemplary waveforms of air pressure in a stimulation device (104, 109, 110, and 111) during operation of the actuator 102 as a stroking motion of the voice coil assembly 138 when a single valve is used.
Figure 19B:
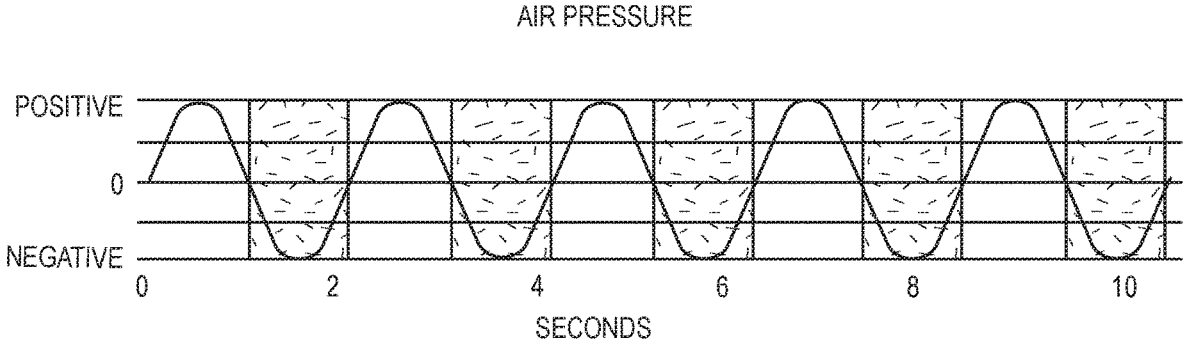

FIGS. 19A-19B illustrate exemplary waveforms of air pressure in a closed air system encompassing the air chamber 122, hose 108 and a stimulation device such as receiver 104 during operation of the actuator 102 as a stroking motion of voice coil assembly 138 is provided. FIG. 19A shows the operation of an electronically operated "closed air circuit" valve 124 for allowing additional air into the pneumatic sex aid system or venting excess air. Valve 124 (shown in the actuator 102 diagram of FIG. 2) is open during shaded time (while pressure is positive) to let air out of closed air volume. As the volume of air in the closed air circuit is reduced, the receiver sleeve 166 will deflate more completely, resulting in the receiver 104 moving further down on the operator for any position of the voice coil assembly 138. FIG. 19B illustrates exemplary waveforms with valve 124 open during shaded time (while pressure is negative) to let air in to closed air circuit. As the volume of air in the closed air circuit increases, the receiver sleeve 166 will inflate more completely, resulting in the receiver 104 moving further up on the operator for any position of the voice coil assembly 138. Adjustments of the volume of air in the closed are circuit will have similar effects on the operation of other devices which may be used in the system such as an inflatable insertable device 109, actuated tube device 110, actuated insertable device 11, or other similar devices. This figure demonstrates when the first air valve would be opened or closed depending on the chamber pressure as described in paragraph 35. This is only applicable when a single valve is used for adjusting the volume of air in the air circuit. It is not applicable when two valves are used with check valves.

FIGS. 20A-20F show graphs with various wave forms (e.g., sinusoidal waves) capable of being produced by various features of the system 100. These graphs represent the position and movement setpoints received by the controller 146 from the interface 105 or other control source. For motion (forces and accelerations) within the capability the voice coil 140, magnet assembly 142, and controller 146, these graphs also represent the motion of the voice coil assembly 138 (shown in FIG. 2) in the actuator 102 as measured by the sensing element 148. When commanded motion is outside of the capability of these components (or when the force is limited to less than the full capability by the user, external control, or as required to prevent overheating of the coil 140) the motion will approximate the commanded motion within the actual capability at any given point in time. In these graphs, the X-axis would be time (e.g., in seconds) and the Y-axis is a normalized position of the voice coil assembly 138 with 1000 fully in one direction from the midpoint of the position sensor to −1000 being fully in the other direction from the midpoint.

Figure 20A:
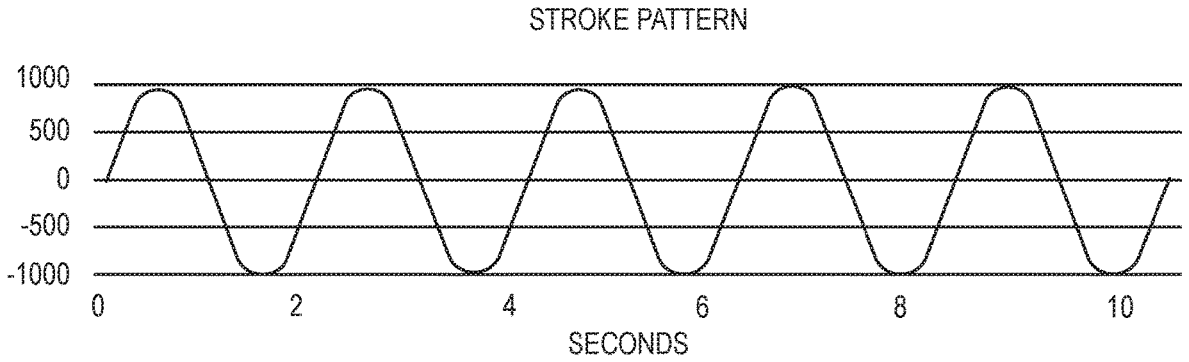
FIGS. 20A-20F show graphs with various wave forms (e.g., sinusoidal waves) capable of being produced by various features of the system and method 100.

FIG. 20A shows an exemplary waveform for a stroke pattern for a receiver 104 or a insertable device 109 as well as devices 110, 111, 250 and 270.

Figure 20B:
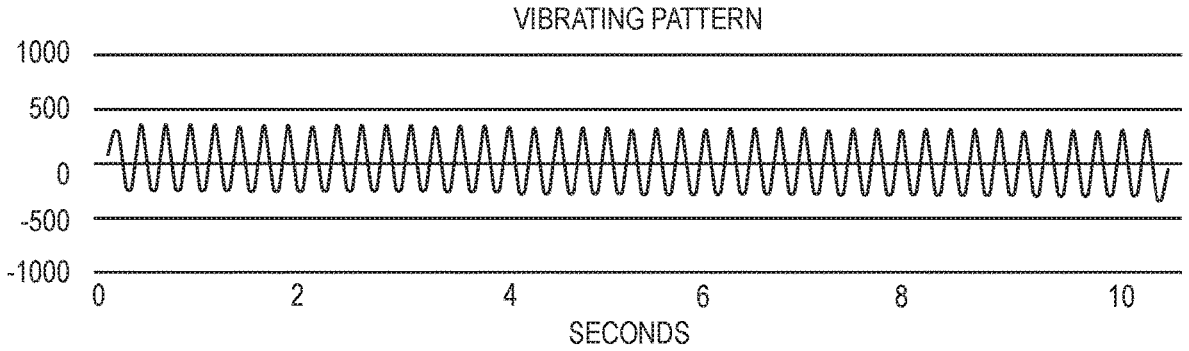

FIG. 20B illustrates an exemplary waveform for a vibrating pattern for a receiver 104, insertable device 109, actuated tube device 110 or actuated insertable device 111.

Figure 20C:
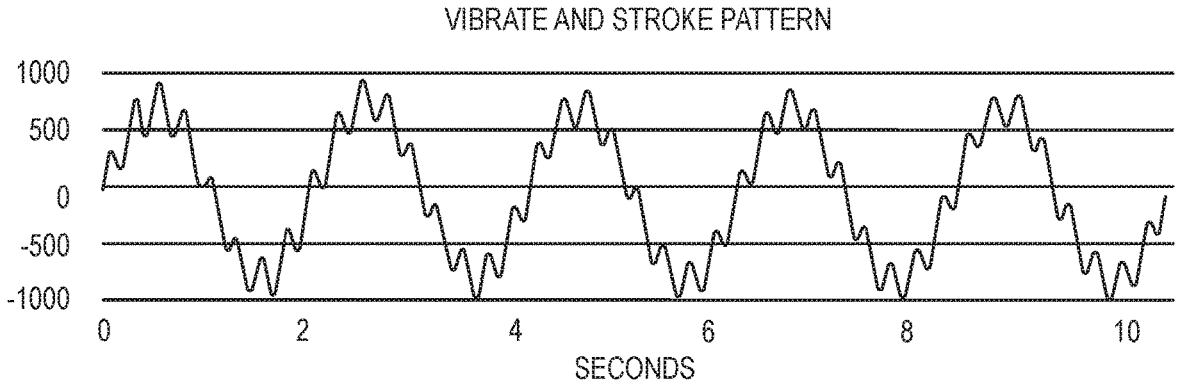

FIG. 20C shows an exemplary composite waveform for both a stroke pattern and a vibrating pattern for a receiver 104, insertable device 109, actuated tube device 110, or actuated insertable device 111.

Figure 20D:
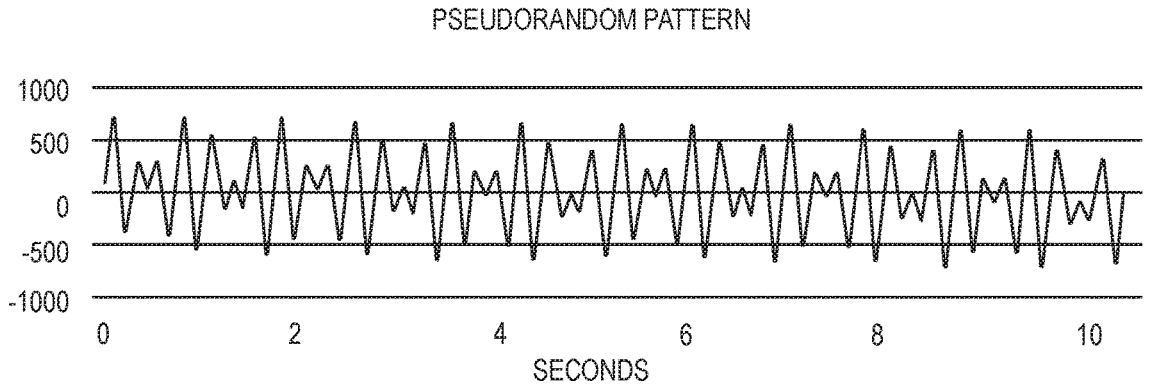

FIG. 20D illustrates an exemplary composite waveform for a waveform that has a pattern which would be difficult to recognize as cyclical by the user for a receiver 104, insertable device 109, actuated tube device 110, or actuated insertable device 111.

Figure 20E:
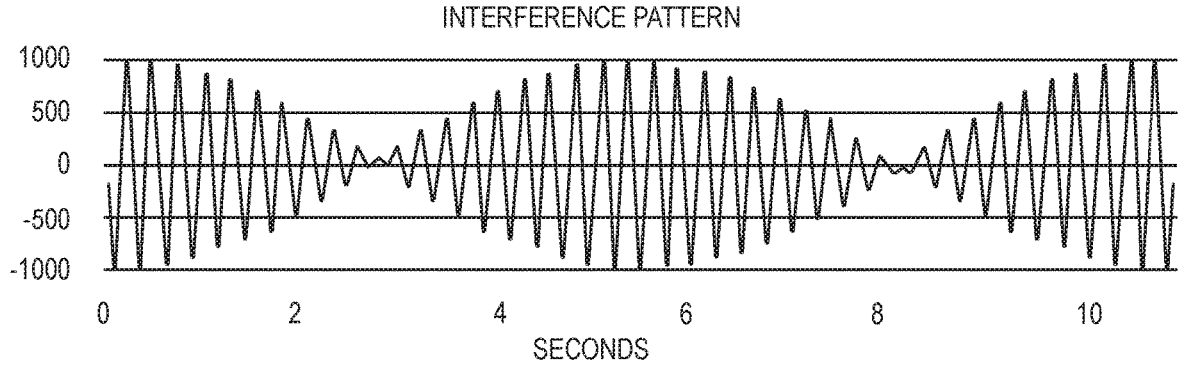

FIG. 20E shows an exemplary waveform for an interference pattern for a receiver 104, insertable device 109, actuated tube device 110, or actuated insertable device 111. This waveform is generated by the sum of two sine waves with similar frequencies.

Figure 20F:
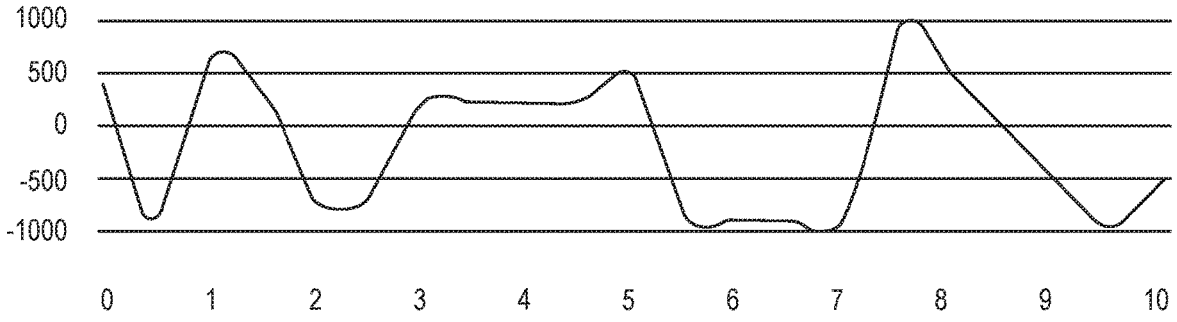

FIG. 20F shows an exemplary waveform for an arbitrary pattern for a receiver 104, insertable device 109, actuated tube device 110, or actuated insertable device 111.

As discussed above the movement and air pressure of the actuator 102 can be controlled by an interface 105 which may be a hand controller (e.g., hard wired and/or wireless), a mobile device (e.g., an iPhone) with an application, a tablet (e.g., an iPad), and/or a computer. The interface 105 can be either be used locally by the user, a partner using the actuator 102 jointly with the user, and/or the actuator can be operated remotely by a remote user. The actuator 102 can also be with some type of visual or aural entertainment media such as a video game, streaming media, and/or a stored media program. The actuator 102 may be synchronized with the entertainment media if appropriately encoded with motion information. For exemplary purposes, the interface may be coupled to other devices, such as other actuators 102, Virtual Reality (VR) devices, and/or bio-feedback sensors for synchronized or coordinated motion.

Figure 21:
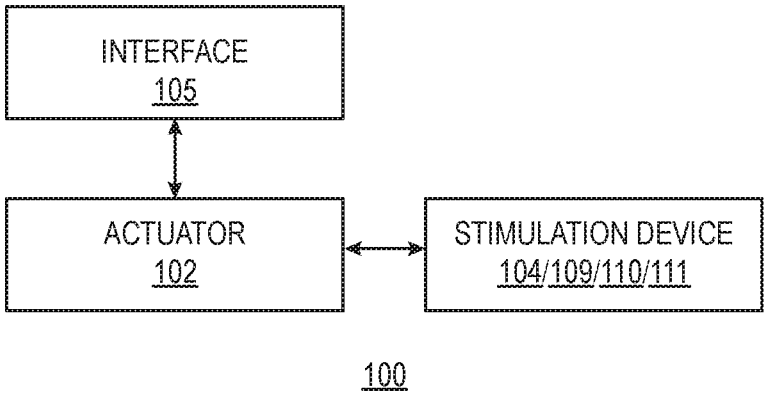
FIG. 21 shows a block diagram of the automated stimulation system and method 100.

FIG. 21 shows a block diagram of the automated stimulation system and method 100.

Figure 22:
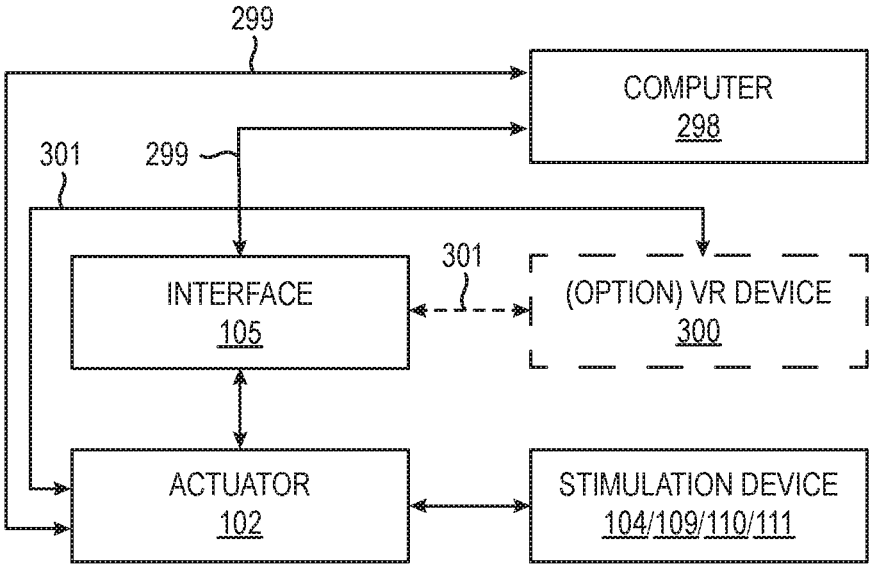
FIG. 22 shows a block diagram of the automated stimulation system and method 100 used with a computer 298 and/or optional virtual reality device 300.

FIG. 22 shows a block diagram of the automated stimulation system and method 100 used with a computer 298 connected to interface 105 or to actuator 102 through lines 299. An optional virtual reality device 300 may also be connected to interface 105 or actuator 102 through lines 301.

Figure 23:
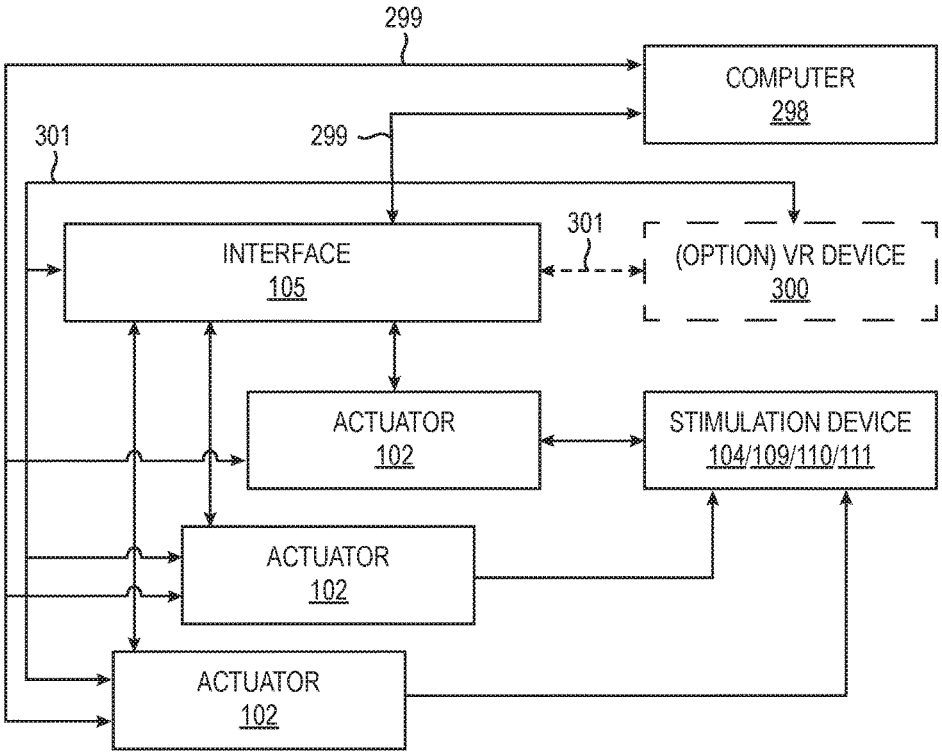
FIG. 23 shows a block diagram of another embodiment of the automated simulation system and method 100 with a plurality of actuators (e.g., three instead of one) capable of moving various sections of a stimulation device (104, 109, 110 or 111).

FIG. 23 shows a block diagram of another embodiment of the automated simulation system and method 100 with a plurality of actuators (e.g., three instead of one) capable of moving various sections of a stimulation device (104, 109, 110 or 111). Optionally, a computer 298 and/or a virtual reality device 300 may be added to this system.

Figure 24:
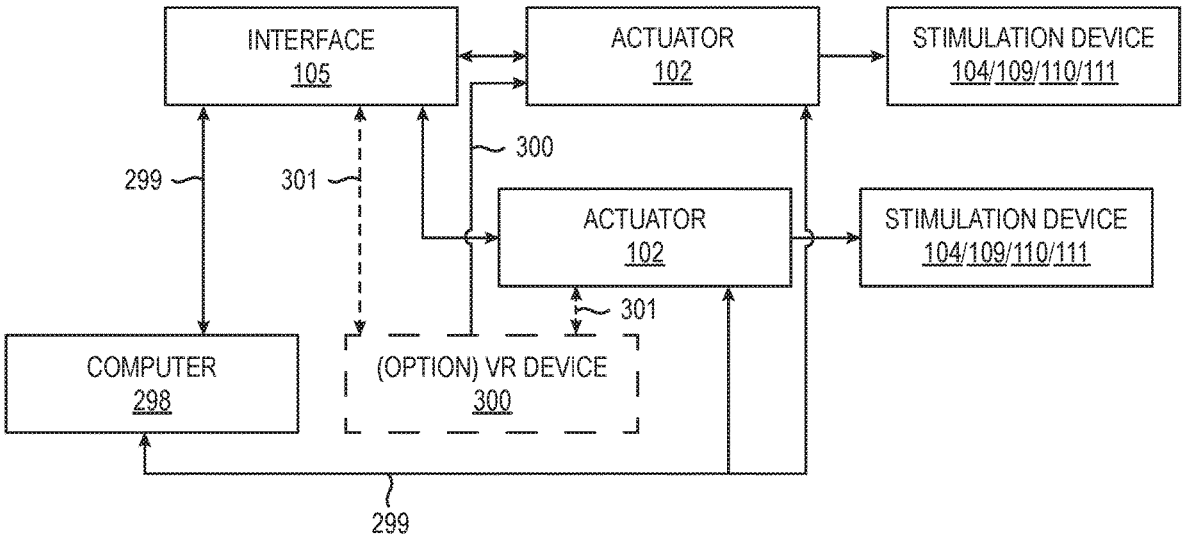
FIG. 24 shows a block diagram of another embodiment of the automated stimulation system and method 100 with two actuators 102 concurrently controlling two stimulation devices (which may be different types) (104, 109, 110 and/or 111).

FIG. 24 shows a block diagram of another embodiment of the automated stimulation system and method 100 with two actuators 102 concurrently controlling two stimulation devices (which may be different types) (104, 109, 110 and/or 111). In alternative embodiments, two or more stimulation devices in any combination could be used. Optionally, a computer 298 and/or a virtual reality device 300 may be added to this system.

Figure 25:
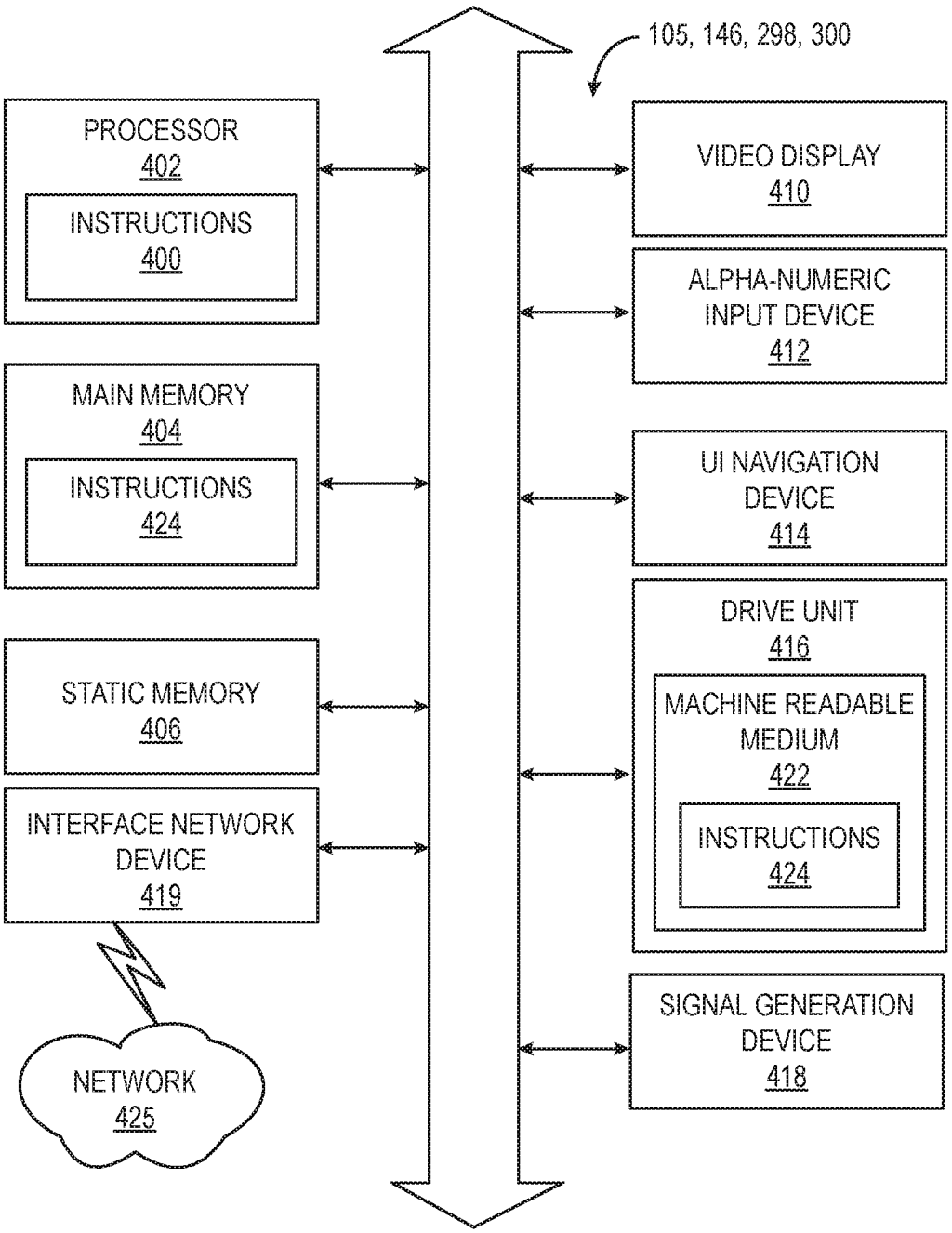
FIG. 25 shows an exemplary block diagram of a computer device such as an interface 105, actuator controller 146, a computer 298, and/or a virtual reality device 300.

FIG. 25 is a block diagram illustrating in a more detailed manner the components of the interface 105, controller 146, a computer 298, and/or a virtual reality device 300 according to some exemplary embodiments, able to read instructions from a machine-readable medium (e.g., a machine-readable storage medium) and perform any one or more of the methodologies discussed herein. Interface 105, controller 146, a computer 298, and/or a VR device 300 may be controlled by a single operator locally, joint operators locally, a single operator and/or joint operators remotely via the network interface device 419. The interface 105, controller 146, computer 298, and/or VR device 300 may also be controlled by a machine (or a plurality of machines locally and/or remotely via the network interface device 419). Specifically, FIG. 25 shows a diagrammatic representation of the devices 105, 146, 298 and/or 300 in the exemplary form of a computer system and within which instructions 400 (e.g., software) for causing the devices 105, 146, 298 and/or 300 to perform any one or more of the methodologies discussed herein may be executed. In alternative embodiments, the devices 105, 146, 298, and/or 300 operate as a standalone device or may be connected (e.g., networked) to other machines. In a networked deployment, the devices 105, 146, 298, and/or 300 may operate in the capacity of a server machine or a client machine in a server-client network environment, or as a peer machine in a peer-to-peer (or distributed) network environment. The devices 105, 146, 298, and/or 300 may be a server computer, a client computer, a user entity computer (PC), a tablet computer, a laptop computer, a netbook, a set-top box (STB), a user entity digital assistant (PDA), a cellular telephone, a smartphone, a web appliance, a network router, a network switch, a network bridge, or any machine capable of executing the instructions 400, sequentially or otherwise, that specify actions to be taken by that server. Further, while only a single device of the plurality of devices 105, 146, 298, and/or 300 is illustrated, the terms "device", "computer", "controller" and/or "server" shall also be taken to include a collection of devices, computers, controllers, and/or servers that individually or jointly execute the instructions 400 to perform any one or more of the methodologies discussed herein.

The devices 105, 146, 298, and/or 300 includes the processor 402 (e.g., a central processing unit (CPU), a graphics processing unit (GPU), a digital signal processor (DSP), an application specific integrated circuit (ASIC), a radio-frequency integrated circuit (RFIC), or any suitable combination thereof), a main memory, and a static memory 406, which are configured to communicate with each other via a bus 408. The devices 105, 146, 298, and/or 300 may further include a graphics display 410 (e.g., a plasma display panel (PDP), a light emitting diode (LED) display, a liquid crystal display (LCD), a projector, or a cathode ray tube (CRT)). The devices 105, 146, 298, and/or 300 may also include an alphanumeric input device 412 (e.g., a keyboard), a cursor control device 414 (e.g., a mouse, a touchpad, a trackball, a joystick, a motion sensor, or other pointing instrument), a storage unit (e.g., drive storage unit) 416, a signal generation device 418 (e.g., a speaker), and network interface device 419.

The storage unit 416 includes a machine-readable medium 422 on which is stored the instructions 424 (e.g., software) embodying any one or more of the methodologies or functions for operation of the automated simulation system and method 100 described herein. The instructions 424 may also reside, completely or at least partially, within the main memory 404, within the processor 402 (e.g., within the processor's cache memory), or both, during execution thereof by the devices 105, 146, 298, and/or 300. Accordingly, the main memory 404 and the processor 402 may be considered as machine-readable media. The instructions 400 may be transmitted or received over network 425 via the network interface device 419.

As used herein, the term "memory" refers to a machine-readable medium able to store data temporarily or permanently and may be taken to include, but not be limited to, random-access memory (RAM), read-only memory (ROM), buffer memory, flash memory, and cache memory. While the machine-readable medium 422 is shown in an example embodiment to be a single medium, the term "machine-readable medium" should be taken to include a single medium or multiple media (e.g., a centralized or distributed database, or associated caches and servers) able to store instructions. The term "machine-readable medium" shall also be taken to include any medium, or combination of multiple media, that is capable of storing instructions (e.g., software) for execution by a server (e.g., server), such that the instructions, when executed by one or more processors of the machine (e.g., processor 402), cause the machine to perform any one or more of the methodologies described herein. Accordingly, a "machine-readable medium" refers to a single storage apparatus or device, as well as "cloud-based" storage systems or storage networks that include multiple storage apparatus or devices. The term "machine-readable medium" shall accordingly be taken to include, but not be limited to, one or more data repositories in the form of a solid-state memory, an optical medium, a magnetic medium, or any suitable combination thereof.

Substantial variations may be made in accordance with specific requirements to the embodiments disclosed. For example, customized hardware might also be used, and/or particular elements might be implemented in hardware, software (including portable software, such as applets, etc.), or both.

The devices 105, 146, 298, and/or 300 alternatively could function in a fully virtualized environment. A virtual machine is where all hardware is virtual and operation is run over a virtual processor. The benefits of computer virtualization have been recognized as greatly increasing the computational efficiency and flexibility of a computing hardware platform. For example, computer virtualization allows multiple virtual computing machines to run on a common computing hardware platform. Similar to a physical computing hardware platform, virtual computing machines include storage media, such as virtual hard disks, virtual processors, and other system components associated with a computing environment. For example, a virtual hard disk can store the operating system, data, and application files for a virtual machine. Virtualized computer system includes computing device or physical hardware platform, virtualization software running on hardware platform, and one or more virtual machines running on hardware platform by way of virtualization software. Virtualization software is therefore logically interposed between the physical hardware of hardware platform and guest system software running "in" virtual machine. Memory of the hardware platform may store virtualization software and guest system software running in virtual machine. Virtualization software performs system resource management and virtual machine emulation. Virtual machine emulation may be performed by a virtual machine monitor (VMM) component. In typical implementations, each virtual machine (only one shown) has a corresponding VMM instance. Depending on implementation, virtualization software may be unhosted or hosted. Unhosted virtualization software generally relies on a specialized virtualization kernel for managing system resources, whereas hosted virtualization software relies on a commodity operating system—the "host operating system"—such as Windows or Linux to manage system resources. In a hosted virtualization system, the host operating system may be considered as part of virtualization software.

Similarly, the methods described herein may be at least partially processor-implemented, a processor being an example of hardware. For example, at least some of the operations of a method may be performed by one or more processors or processor-implemented modules. Moreover, the one or more processors may also operate to support performance of the relevant operations in a "cloud computing" environment or as a "software as a service" (SaaS). For example, at least some of the operations may be performed by a group of computers (as examples of machines including processors), with these operations being accessible via a network (e.g., the Internet) and via one or more appropriate interfaces (e.g., an application program interface (API)).

The performance of certain of the operations may be distributed among the one or more processors, not only residing within a single machine, but deployed across a number of machines. In some example embodiments, the one or more processors or processor-implemented modules may be located in a single geographic location (e.g., within a home environment, an office environment, or a server farm). In other example embodiments, the one or more processors or processor-implemented modules may be distributed across a number of geographic locations.

Additionally, in one or more steps or blocks, may be implemented using embedded logic hardware, such as, an Application Specific Integrated Circuit (ASIC), Field Programmable Gate Array (FPGA), Programmable Array Logic (PAL), or the like, or combination thereof, instead of a computer program. The embedded logic hardware may directly execute embedded logic to perform actions some or all of the actions in the one or more steps or blocks. Also, in one or more embodiments (not shown in the figures), some or all of the actions of one or more of the steps or blocks may be performed by a hardware microcontroller instead of a CPU. In one or more embodiment, the microcontroller may directly execute its own embedded logic to perform actions and access its own internal memory and its own external Input and Output Interfaces (e.g., hardware pins and/or wireless transceivers) to perform actions, such as System On a Chip (SOC), or the like.

One of the uses of the system 100 may be used for stimulation without erection for sufferers of erectile dysfunction.

Figure 26:
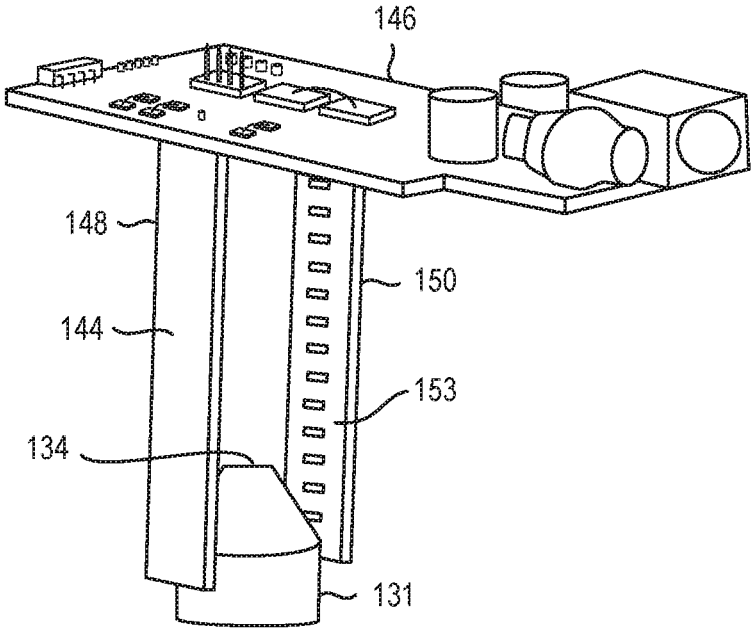
FIG. 26 illustrates the position sensor assembly 144 capable of operating in different applications and environments than in the actuator 102.

FIG. 26 illustrates an alternative embodiment with the position sensor assembly 144 capable of operating in different applications and environments than in the actuator 102.

Figure 27:
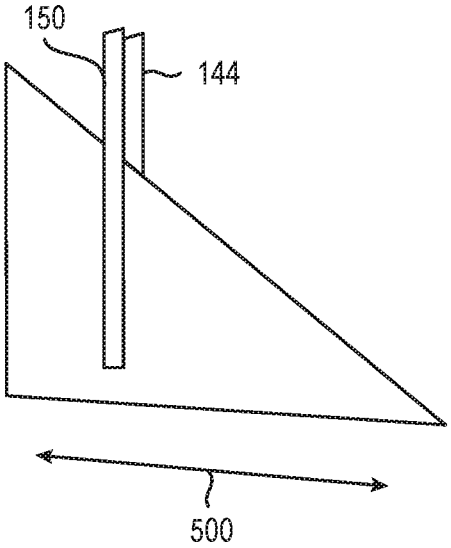
FIG. 27 shows exemplary perspective view of a smooth ramp of occlusion of light sources in a position sensor assembly 144 allowing for measurement of linear position with strokes much longer than the length of a position sensor assembly 144 itself.

Specifically, FIG. 27 shows exemplary perspective view of a ramp used for occlusion of a light emitting element in a position sensor. In this embodiment, motion of the ramp along the direction of the arrow 500 varies the level of occlusion of the position sensor assembly 144, allowing measurement of the position of the ramp. This method allows for an arbitrarily long position measurement range relative to the length of the position sensor assembly 144 itself. Position sensor assembly 144 operates on the principal of occlusion of a self-contained light source. This position sensor assembly 144 can have uses outside of this specific application where position information is required with low cost and relatively low accuracy, but with high reliability, long life, and/or without interference from magnetic fields. Examples of such applications may be found in the fields of transportation, manufacturing, and bulk material handling.

Figure 28:
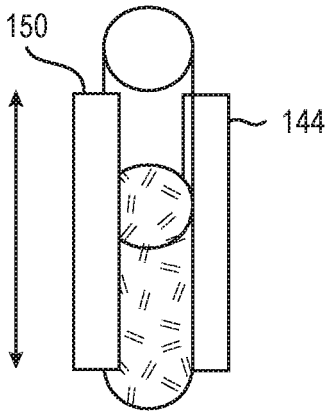
FIG. 28 shows an exemplary perspective view of measurement of a level of an opaque fluid in a transparent tube, wherein the position measurement of the fluid could also be applied to a transparent fluid with an opaque object floating on top of the fluid in the transparent tube (not shown).

FIG. 28 shows an exemplary perspective view of measurement of a level of an opaque fluid in a transparent tube, wherein the position measurement of the fluid could also be applied to a transparent fluid with an opaque object floating on top of the fluid in the transparent tube (not shown).

It will be understood that each block of the flowchart illustrations, and combinations of blocks in the flowchart illustrations, (or actions explained above with regard to one or more systems or combinations of systems) can be implemented by computer program instructions. These program instructions may be provided to a processor to produce a machine, such that the instructions, which execute on the processor, create means for implementing the actions specified in the flowchart block or blocks. The computer program instructions may be executed by a processor to cause a series of operational steps to be performed by the processor to produce a computer-implemented process such that the instructions, which execute on the processor to provide steps for implementing the actions specified in the flowchart block or blocks. The computer program instructions may also cause at least some of the operational steps shown in the blocks of the flowcharts to be performed in parallel. Moreover, some of the steps may also be performed across more than one processor, such as might arise in a multi-processor computer system. In addition, one or more blocks or combinations of blocks in the flowchart illustration may also be performed concurrently with other blocks or combinations of blocks, or even in a different sequence than illustrated without departing from the scope or spirit of the invention.

The above specification, examples, and data provide a complete description of the manufacture and use of the invention. Since many embodiments of the invention can be made without departing from the spirit and scope of the invention, the invention resides in the claims hereinafter appended. The term "approximately" as used herein shall mean with plus or minus 2 percent of the value being measured.

The foregoing described embodiments have been presented for purposes of illustration and description and are not intended to be exhaustive or limiting in any sense. Alterations and modifications may be made to the embodiments disclosed herein without departing from the spirit and scope of the invention. No language in the specification should be construed as indicating any non-claimed element as essential to the practice of the invention. The actual scope of the invention is to be defined by the claims. In the foregoing specification, embodiments have been described with reference to specific exemplary embodiments thereof. It will be evident that various modifications may be made thereto without departing from the broader spirit and scope of the invention as set forth in the following claims. The specification and drawings are, accordingly, to be regarded in an illustrative sense rather than a restrictive sense.

Although process (or method) steps may be described or claimed in a particular sequential order, such processes may be configured to work in different orders. In other words, any sequence or order of steps that may be explicitly described or claimed does not necessarily indicate a requirement that the steps be performed in that order unless specifically indicated. Further, some steps may be performed simultaneously despite being described or implied as occurring non-simultaneously (e.g., because one step is described after the other step) unless specifically indicated. Moreover, the illustration of a process by its depiction in a drawing does not imply that the illustrated process is exclusive of other variations and modifications thereto, does not necessarily imply that the illustrated process or any of its steps are necessary to the embodiment(s), and does not imply that the illustrated process is preferred.

The definitions of the words or elements of the claims shall include not only the combination of elements which are literally set forth, but all equivalent structure, material or acts for performing substantially the same function in substantially the same way to obtain substantially the same result.

Neither the Title (set forth at the beginning of the first page of the present application) nor the Abstract (set forth at the end of the present application) is to be taken as limiting in any way as the scope of the disclosed invention(s). The title of the present application and headings of sections provided in the present application are for convenience only, and are not to be taken as limiting the disclosure in any way.

Devices that are described as in "communication" with each other or "coupled" to each other need not be in continuous communication with each other or in direct physical contact, unless expressly specified otherwise. On the contrary, such devices need only transmit to each other as necessary or desirable, and may actually refrain from exchanging data most of the time. For example, a machine in communication with or coupled with another machine via the Internet may not transmit data to the other machine for long period of time (e.g. weeks at a time). In addition, devices that are in communication with or coupled with each other may communicate directly or indirectly through one or more intermediaries.

It should be noted that the recitation of ranges of values in this disclosure are merely intended to serve as a shorthand method of referring individually to each separate value falling within the range, unless otherwise indicated herein, and each separate value is incorporated into the specification as if it were individually recited herein. Therefore, any given numerical range shall include whole and fractions of numbers within the range. For example, the range "1 to 10" shall be interpreted to specifically include whole numbers between 1 and 10 (e.g., 1, 2, 3, . . . 9) and non-whole numbers (e.g., 1.1, 1.2, . . . 1.9).

The invention claimed is:

1. A sexual stimulation system comprising:

an actuator comprising:

a hose port connected to an air chamber;

air volume in the air chamber capable of being controlled by location and movement of a piston, wherein the piston is capable of being driven by a coil moving within a magnetic field assembly; and a shaft attached to the piston capable of moving linearly in the actuator within a position sensor assembly to control the positioning of the piston, wherein the position sensor assembly includes a sensing element capable of detecting output of a light emitting element and a reference sensor capable of enabling compensation of the position sensor assembly output as temperature varies.

2. The system of claim 1, wherein the coil is a voice coil.

3. The system of claim 1, further comprising:

an air spring valve capable of enabling a pressure offset in a closed air circuit formed by the air chamber and an attachable hose and stimulation device.

4. The system of claim 1 further comprising:

a receiver having a receiver sleeve and capable of being connected to the actuator by a hose at a receiver hose port to form a closed air circuit with the hose and the air chamber of the actuator; and an elastic seal on the receiver capable of maintaining air tightness regardless of the level of inflation of the receiver sleeve to prevent the receiver from being driven off the operator.

5. The system of claim 4, wherein the receiver sleeve may be made of silicone.

6. The system of claim 1 further comprising:

an inflatable insertable device capable of being connected to the actuator by a hose at a hose port to form a closed air circuit with the hose and the air chamber of the actuator.

7. The system of claim 1 further comprising:

an actuated tube device capable of being connected to the actuator by a hose at a hose port to form a closed air circuit with the hose and the air chamber of the actuator.

8. The system of claim 1 further comprising:

an actuated insertable device capable of being connected to the actuator by a hose at a hose port to form a closed air circuit with the hose and the air chamber of the actuator.

9. The system of claim 4, wherein the receiver sleeve has one of the group consisting of: a plurality of internal protruding features integrated into the receiver sleeve; a plurality of internal recessed features integrated into the receiver sleeve; and an internal surface texture molded into the receiver sleeve.

10. The system of claim 1, wherein the actuator is capable of being driven in an arbitrary motion pattern.

11. The system of claim 1, wherein the actuator is capable of connecting to, being controlled through, or providing feedback through a computer network.

12. A method comprising:

controlling the output of an actuator by using a position sensor assembly to determine the location and movement of a piston driven through a coil moving in a magnetic field assembly to adjust the air volume in an air chamber wherein a cone is positioned at the tip of a shaft that moves back and forth with each stroke of the piston to improve linearity of the sensed position when used with a plurality of light emitting elements in the position sensor assembly; and feeding the output of the actuator through a hose to a stimulation device.

13. The method of claim 12, wherein the stimulation device is one of the group consisting of: a receiver, an inflatable insertable device, an actuated tube device, and an actuated insertable device.

14. A sexual stimulation system comprising:

an actuator comprising:

an air chamber formed by an air chamber piece with integrated hose port;

a first part of a rolling diaphragm attached to the air chamber piece and capable of being stationary during operation of the actuator and a second part of the rolling diaphragm capable of forming a seal with a piston and moving with the piston during operation of the actuator;

air volume in the air chamber capable of being controlled by location and movement of the piston;

wherein the piston is driven by a voice coil moving through a magnetic field assembly;

a position sensor assembly includes a plurality of light emitting elements and a light sensing element in which the shaft moves in between; and a cone positioned at the tip of the shaft so that the cone is capable of moving back and forth with each stroke of the piston to improve linearity of the sensed position when used with a plurality of light emitting elements.

15. The system of claim 14, further comprising:

an air spring valve capable of enabling a pressure offset in a closed air circuit formed by the air chamber and an attachable hose and stimulation device.

16. The system of claim 14 further comprising:

a receiver having a receiver sleeve and capable of being connected to the actuator by a hose at the integrated hose port to form a closed air circuit with the hose and the air chamber of the actuator; and an elastic seal on the receiver capable of maintaining air tightness regardless of the level of inflation of the receiver sleeve to prevent the receiver from being driven off an operator.

17. The system of claim 16, wherein the receiver sleeve has one of the group consisting of: a plurality of internal protruding features integrated into the receiver sleeve; a plurality of internal recessed features integrated into the receiver sleeve; and an internal surface texture molded into the receiver sleeve.

18. The system of claim 14, wherein the receiver sleeve may be made of silicone.

19. The system of claim 14 further comprising:

an inflatable insertable device capable of being connected to the actuator by a hose at the integrated hose port to form a closed air circuit with the hose and the air chamber of the actuator.

20. The system of claim 14 further comprising:

an actuated tube device capable of being connected to the actuator by a hose at the integrated hose port to form a closed air circuit with the hose and the air chamber of the actuator.

21. The system of claim 14 further comprising:

an actuated insertable device capable of being connected to the actuator by a hose at the integrated hose port to form a closed air circuit with the hose and the air chamber of the actuator.

22. The system of claim 14, wherein the actuator is capable of being driven in an arbitrary motion pattern.

23. The system of claim 14, wherein the actuator is capable of connecting to, being controlled through, or providing feedback through a computer network.

* * * * *